US007472780B2

(12) United States Patent
Choi

(10) Patent No.: US 7,472,780 B2
(45) Date of Patent: Jan. 6, 2009

(54) COIN SORTING APPARATUS, CONTROL SYSTEM FOR CONTROLLING COIN SORTING APPARATUS, AND METHOD FOR SORTING COINS

(75) Inventor: Hun Choi, Incheon-si (KR)

(73) Assignee: Royal Sovereign Inc. (KR)

( * ) Notice: Subject to any disclaimer, the term of this patent is extended or adjusted under 35 U.S.C. 154(b) by 637 days.

(21) Appl. No.: 10/666,200

(22) Filed: Sep. 18, 2003

(65) Prior Publication Data

US 2004/0222062 A1 Nov. 11, 2004

(30) Foreign Application Priority Data

May 6, 2003 (KR) ..... 10-2003-0028586

(51) Int. Cl.
*G07D 9/06* (2006.01)

(52) U.S. Cl. ..... 194/334

(58) Field of Classification Search ..... 453/3–5, 453/9, 12, 13, 58; 194/334, 215–217, 350; 312/330.1, 331, 332, 334.1, 350; 446/8, 446/10; 403/359.4; 53/447, 531, 532, 212, 53/254

See application file for complete search history.

(56) References Cited

U.S. PATENT DOCUMENTS 2,740,242 A * 4/1956 Downey ..... 53/506
3,002,601 A * 10/1961 Reis ..... 194/200
3,658,394 A * 4/1972 Gutner ..... 384/21
5,163,868 A * 11/1992 Adams et al. ..... 453/11
5,271,586 A * 12/1993 Schmidt ..... 248/58
5,902,178 A * 5/1999 Perkitny ..... 453/9
5,989,118 A * 11/1999 Chiba et al. ..... 453/11
6,021,883 A * 2/2000 Casanova et al. ..... 194/217
6,371,845 B1 * 4/2002 Ishida et al. ..... 453/17
6,484,863 B1 * 11/2002 Molbak ..... 194/216
6,772,870 B2 * 8/2004 Sugai et al. ..... 194/217
7,048,623 B2 * 5/2006 Perkitny ..... 453/13
2006/0054457 A1 * 3/2006 Long et al. ..... 194/347

* cited by examiner

*Primary Examiner*—Patrick Mackey
*Assistant Examiner*—Mark Beauchaine
(74) *Attorney, Agent, or Firm*—Holland & Knight LLP; Richard E. Lyon, Jr.

(57) ABSTRACT

Disclosed is a coin sorting apparatus whose operation is controlled by sensing means to count the received coins. The coin sorting apparatus includes a coin sorting device for sorting coins according to size of the coins, a guide for transferring the coins sorted by the coin sorting device to a predetermined location, a first sensor for counting the number of the coins being sorted, the first sensor being formed on the guide, a coin receiving tube disposed on an end portion of the guide to receive the coins transferred from the guide, a receiving container for receiving the coin receiving tube, the receiving container being provided at a lower side with a second sensing hole and a sliding projection, a sliding member provided with a sliding groove engaged with the sliding projection so that the receiving container can be easily inserted and withdrawn, a second sensor spaced apart from the second sensing hole at a predetermined distance and aligned with the second sensing hole to be in-line; and a microcomputer for controlling the coin sorting apparatus in accordance with signals from the first and second sensors.

32 Claims, 20 Drawing Sheets

COIN SORTING APPARATUS, CONTROL SYSTEM FOR CONTROLLING COIN SORTING APPARATUS, AND METHOD FOR SORTING COINS

BACKGROUND OF THE INVENTION

1. Field of the Invention

The present invention relates to a coin sorting apparatus, and more particularly, to a coin sorting apparatus whose operation is controlled by sensing means to count the received coins.

2. Description of the Related Art

Generally, a coin sorting apparatus refers to a machine for separating and sorting a large amount of coins according to their respective size within a short time, and it is widely used in financial institutions such as banks or businesses to quickly and accurately sort coins.

FIG. 1 is a perspective view showing the appearance of a conventional typical coin sorting apparatus.

As shown in the drawing, the typical conventional coin sorting apparatus includes a coin slot 10 through which a large amount of coins are deposited, a plurality of guides 30 for allowing the coins to be sorted according to their size, a plurality of coin receiving tubes 40 for receiving a predetermined number of the sorted coins, a fallen-coin drawer 35 for collecting coins that are not received in the coin receiving tubes 40, and a power switch 60 for supplying or shutting off power to the coin sorting apparatus.

The operation of the above-described coin sorting apparatus will be briefly described hereinafter. When a user turns on the power switch 60 and inputs coins into the coin slot 10, the input coins are sorted by a sorting unit located below the coin slot 10 and output through the guide 30.

The coins output through the guides 30 are stacked in the coin receiving tube 40. When the coin receiving tubes 40 are arranged in two rows as shown in FIG. 1, the coins are firstly received in a first row of the coin receiving tubes 40 that is proximal to the guides 30.

When the coin receiving tubes 40 proximal to the guides 30 are filled with coins, the coins are secondly received in a second row of the coin receiving tubes 40 that are distal to the guides 30.

When all of the coin receiving tubes 40 are filled with coins or the sorting operation is finished, the user turns off the power switch 60, and take the coin receiving tubes 40 out of the apparatus to use the coins.

FIG. 2 is a sectional view illustrating an inner structure of a conventional coin sorting apparatus.

As shown in the drawing, the coin sorting apparatus includes a coin slot 10 through which coins are deposited, a supply control container 11 for controlling the supply amount of the coins deposited through the coin slot 10 such that a small amount of coins are supplied into a separating unit, a supply hole 12 formed on a sidewall of the supply control container 11 for allowing a small amount of coins to be deposited, a cover 15 for preventing the coins from coming out of the supply control container 11 while the supply control container 11 is rotated, a carrier container 13 for carrying the coins deposited through the supply hole 12 such that the coins are separated and sorted by a carrier hole 14 and separation holes 16, and a rotation shaft 18 and a motor 17 for rotating the supply control container 11 and the carrier container 13.

In addition, the coin sorting apparatus further includes guides 30 for guiding the coins sorted by the separation holes 16, coin receiving tubes 40 for receiving the coins carried out through the guides 30, a tube receiving container 41 for receiving the coin receiving tubes 40, and a fallen-coin drawer 35 for receiving coins that fall down without being received in the coin receiving tubes 40.

The operation of the above-described conventional coin sorting apparatus will be described hereinafter. When a large amount of coins is input through the coin slot 10, the coins are piled up in the supply control container 11. Then, when the supply control container 11 rotates, the coins are fed to the carrier container 13 through the supply hole 12 formed on the sidewall of the supply control container 11, little by little.

The coins that are fed to the carrier container 13 are inserted into the carrier hole 14 formed on the carrier container 13 while the carrier container 13 rotates, and the coins are then moved into the separation holes 16 by the rotation of the carrier container 13.

The separation holes 16 are a plurality of different sizes, and they are provided in an order from smallest to largest in a direction where the carrier hole 14 rotates.

Therefore, the coins are discharged through the separation holes in an order from the smallest coins to the largest coins.

The rotation of the supply control container 11 and the carrier container 13 are realized by the rotation shaft 18 and the motor 17 placed under the carrier container 13.

The sorted coins passing through the separation holes 16 are carried along the guides 30, and received in the coin receiving tubes 40.

The coin receiving tubes 40 can be provided in a number corresponding to sizes of coins, or as shown in the drawings, two coin receiving tubes 40 can be provided for each size of coins.

When all of the coin receiving tubes 40 are filled with coins, subsequent coins fall down to be received in the fallen-coin drawer 35. When the sorting of coins is completed, the user can take the coin receiving tubes 40 out of the apparatus to use a desired denomination of coins.

However, the aforementioned conventional coin sorting apparatus has several problems.

First, when a large amount of coins are sorted, since the apparatus is designed not to automatically stop even when the coin receiving tubes are filled with coins, the user must collect the fallen coins and input the same again for sorting through the coin slot. This is troublesome work for the user.

Second, even when there are no coins in the carrier container, the apparatus keeps operating unless the user turns off the power switch.

Third, since it is impossible to take the coin receiving tubes out of the apparatus to wrap up the sorted coins while the coins are being sorted, the user must turn off the power switch wherever he/she intends to wrap up the sorted coins.

Fourth, when the coin sorting is completed and a coin receiving tube is not filled with the coins, since it is difficult for the user to identify the number of coins received in the coin receiving tube, the user must empty the coins from the coin receiving tube and count them by himself/herself.

SUMMARY OF THE INVENTION

Accordingly, the present invention is directed to a coin sorting apparatus that substantially obviates one or more problems due to limitations and disadvantages of the related art.

An object of the present invention is to provide a coin sorting apparatus whose operation is controlled by a sensor to count the number of coins received.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a coin sorting apparatus comprising: coin sorting means for sorting coins according to size of the coins; a guide for transferring the coins sorted by the coin sorting means to a predetermined location; first sensing means formed on the guide, for counting the number of the coins being sorted; a coin receiving tube disposed on an end portion of the guide, for receiving the coins transferred from the guide; a receiving container for receiving the coin receiving tube, the receiving container being provided at a lower side with a second sensing hole and a sliding projection; a sliding member provided with a sliding groove engaged with the sliding projection so that the receiving container can be easily inserted and withdrawn; second sensing means spaced apart by a predetermined distance from the second sensing hole and aligned with the second sensing hole to be in-line; and a microcomputer for controlling the coin sorting apparatus in accordance with signals from the first and second sensing means.

The coin sorting apparatus may further comprise a speaker for making a predetermined sound according to an operation state of the coin sorting means.

The coin sorting apparatus may further comprise a control/display part for controlling and displaying an operation state of the coin sorting means.

In addition, the microcomputer controls the coin sorting apparatus such that the number or amount of coins being received in the coin receiving tube in the course of the operation of the coin sorting means and the number or amount of coins received in the coin receiving tube when the operation of the coin sorting means is stopped can be distinguishably displayed.

The coin sorting means comprises a motor, a rotational shaft driven by the motor, a carrier container coupled on the rotational shaft and provided with carrier holes through which the coins are carried one by one, and a separation member provided with a plurality of separation holes having different sizes, the separation holes being formed corresponding to the carrier holes to separate the coins according to size.

The sliding projection comprises an extending portion extending downward from the receiving container, upper and lower plates disposed around the extending portion, and an elastic member disposed around the extending portion between the upper and lower plates to bias the upper plate upward to create friction force between the sliding member and the upper plate.

The sensing means is preferably formed of an optical sensor, and the first sensing means is formed to be offset from a center of the guide.

In an aspect of the present invention, there is provided a coin sorting apparatus comprising: first sensing means for counting the number of coins being sorted according to size of the coins; second sensing means for detecting if a coin receiving tube is positioned on a location for appropriately receiving the coins; a microcomputer for controlling the coin sorting apparatus in accordance with signals from the first and second sensing means; and coin sorting means controlled by the microcomputer such that an operation of the coin sorting means is started or stopped.

The coin sorting apparatus may further comprise a speaker for making a predetermined sound when it is determined by the first sensing means that a predetermined number of the coins are sorted or the operation of the coin sorting means is stopped.

The coin sorting apparatus may further comprise a control/display part for controlling and displaying an operation state of the coin sorting means.

In another aspect of the present invention, there is provided a coin sorting apparatus comprising: first sensing means for counting the number of coins being sorted according to size of the coins; a microcomputer for controlling the coin sorting apparatus and displaying the number and/or amount of the sorted coins in accordance with a signal detected by the first sensing means; a user interface allowing a user to control the coin sorting apparatus and displaying an operation state of the coin sorting apparatus; and coin sorting means controlled by the microcomputer such that an operation of the coin sorting means is started or stopped.

The user interface comprises a plurality of control buttons and a display part.

The microcomputer controls the coin sorting apparatus such that amounts of the coins sorted by the size or a total amount of the sorted coins can be displayed.

The microcomputer controls the coin sorting apparatus such that the number of coins sorted by size can be displayed within a predetermined range.

The microcomputer controls the coin sorting apparatus such that the number coins being received in the coin receiving tube in the course of the operation of the coin sorting means and the number of coins received in the coin receiving tube when the operation of the coin sorting means is stopped can be distinguishably displayed.

In still another aspect of the present invention, there is provided a method for sorting coins, the method comprising the steps of: separating the coins by size when a motor is operated; detecting the number of sorted coins by size; stopping an operation of coin sorting means when it is detected that a predetermined number of the coins having a predetermined size is sorted; and operating again the coin sorting means when coin receiving means is displaced to a predetermined location.

The method may further comprise the step of stopping the operation of the coin sorting means when the number of coins being sorted is not increased for a predetermined time.

The method may further comprise the step of making a sound or displaying an image so as to let a user identify the operation stop of the coin sorting means.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
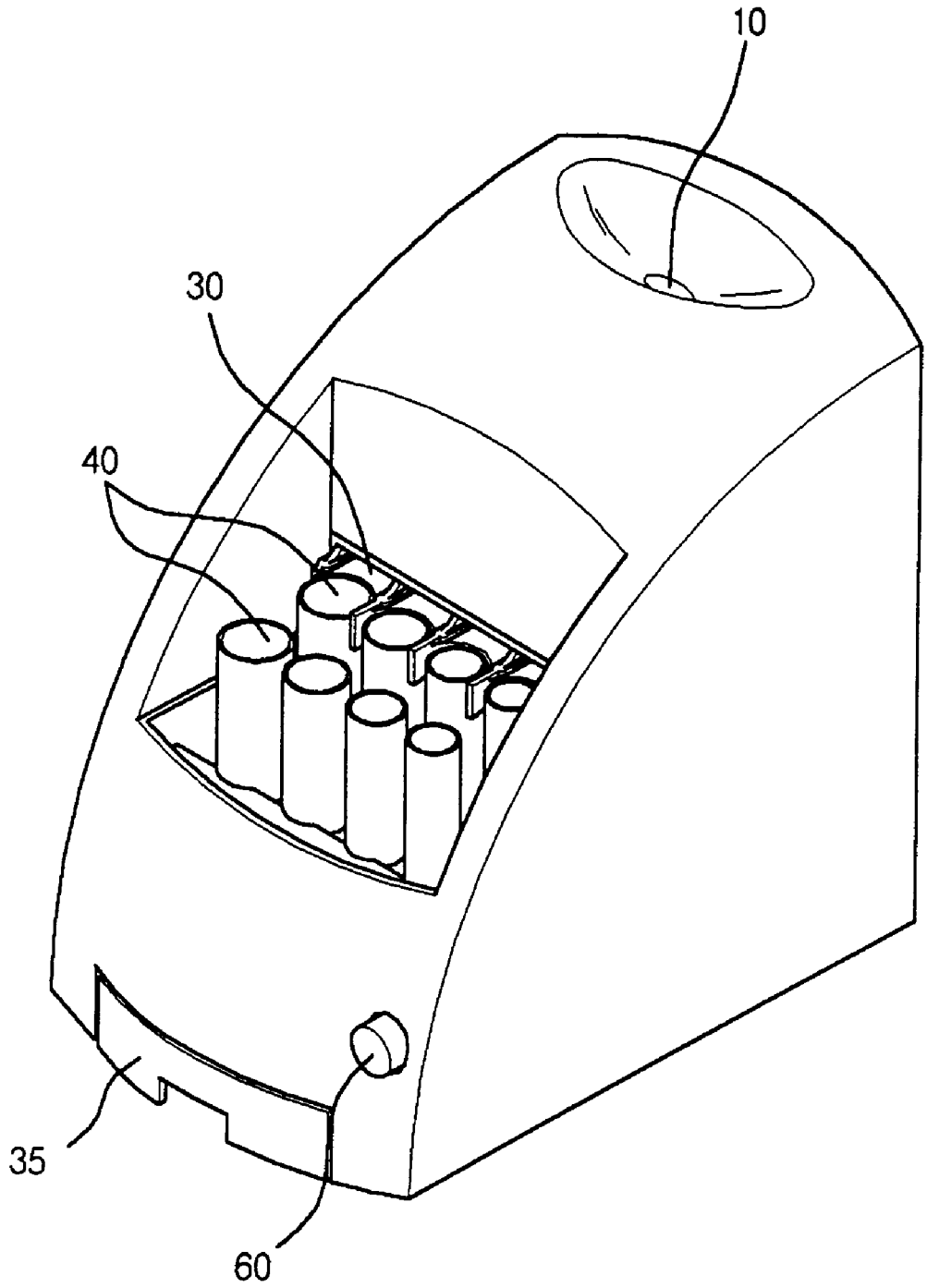
Fig. 1 (Background Art)
FIG. 1 is a perspective view illustrating an outer appearance of a typical conventional coin sorting apparatus.
Figure 2:
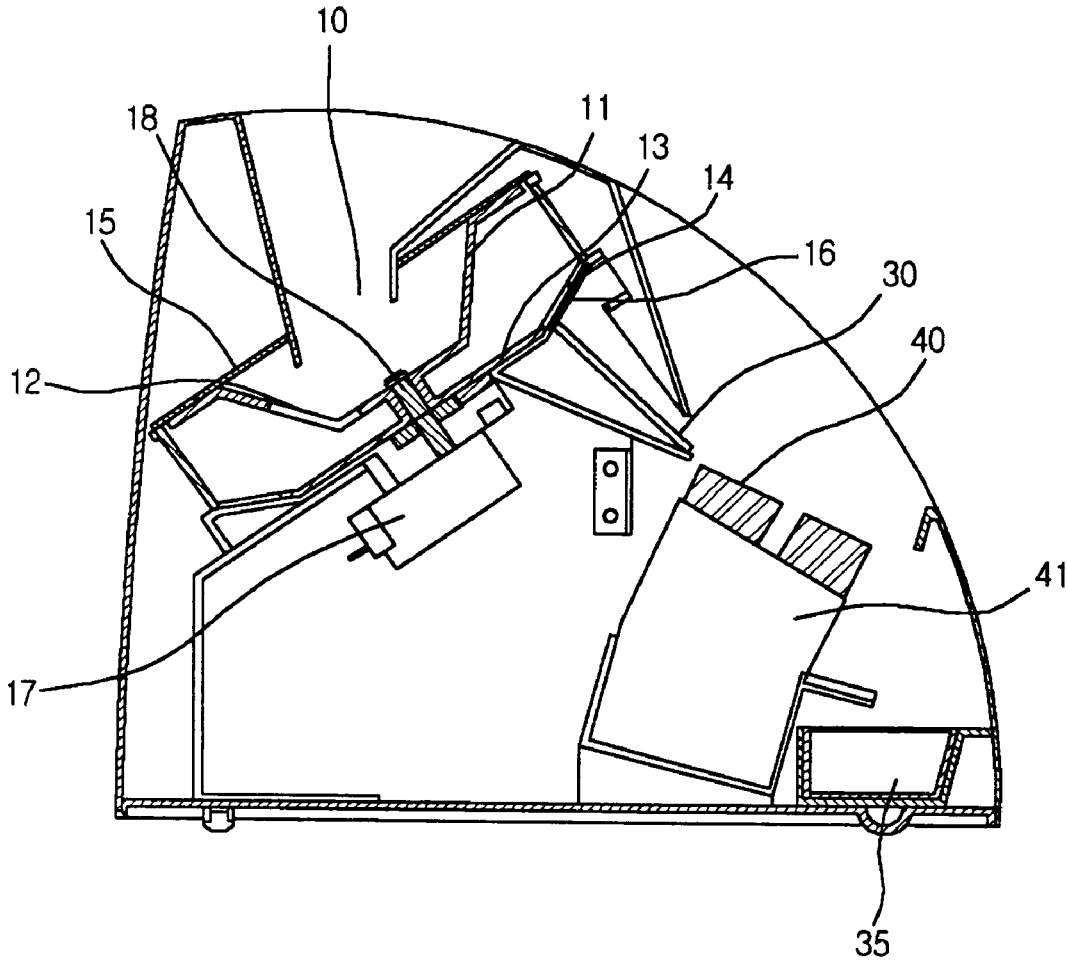
Fig. 2 (Background Art)
FIG. 2 is a sectional view of a typical conventional coin sorting apparatus.
Figure 3:
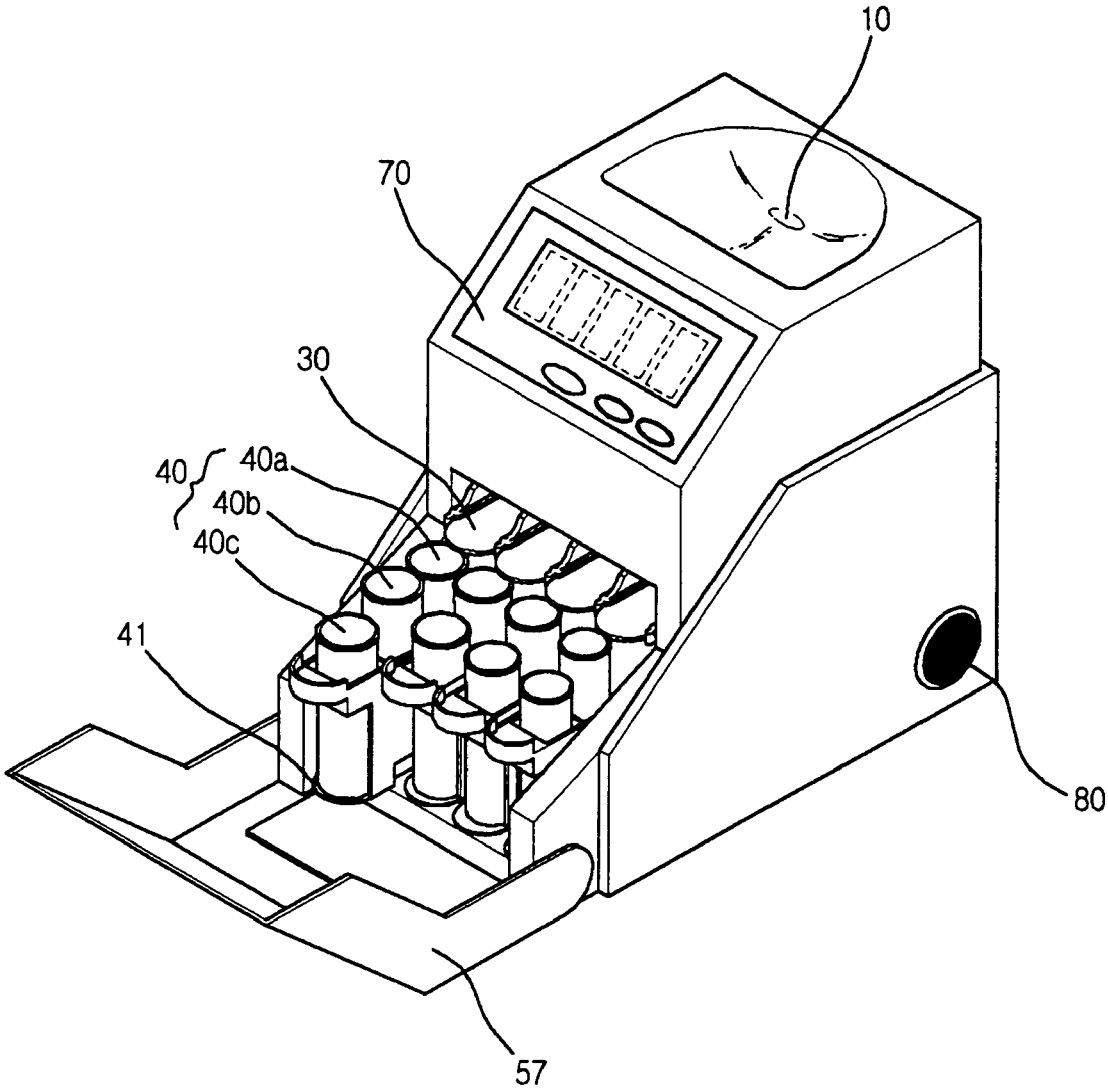
FIG. 3 is a perspective view of an outer appearance of a coin sorting apparatus according to the present invention.

FIG. 3 shows an outer appearance of a coin sorting apparatus according to the present invention.

As shown in the drawing, a coin sorting apparatus of the present invention comprises a coin slot 10 through which coins are deposited; a plurality of guides 30 for allowing the coins to be sorted according to their size; a plurality of coin receiving tubes 40 for receiving a predetermined number of the coins sorted through the guides 30; a control/display part 70 for controlling the operation of the coin sorting apparatus and displaying the number and amount of sorted coins; and a speaker 80 for generating sound in accordance with the operation state of the coin sorting apparatus.

Disposed on a front side of the apparatus is a front cover 57 for preventing the apparatus from being damaged when the apparatus is transported and stored.

Describing the operation of the above-described coin sorting apparatus, when a user turns on a power switch provided on the control/display part 70 and inputs coins into the coin slot 10, the input coins are sorted by sorting means located below the coin slot 10 and output through the guides 30.

Sensing means is provided on the guides 30 so as to count the sorted coins by their denominations.

The number and amount of coins is displayed on the control/display part 70, and the operation of the coin sorting apparatus is stopped when a predetermined number of coins are sorted or the number of sorted coins is not increased for a predetermined time.

In addition, the speaker 80 makes a sound such as a voice or melody to let the user identify the coin sorting state. When the coin receiving tubes 40 are filled with a predetermined number of coins or the coin sorting is completed, the user takes the coin receiving tubes 40 out of the apparatus to use the coins.

Figure 4:
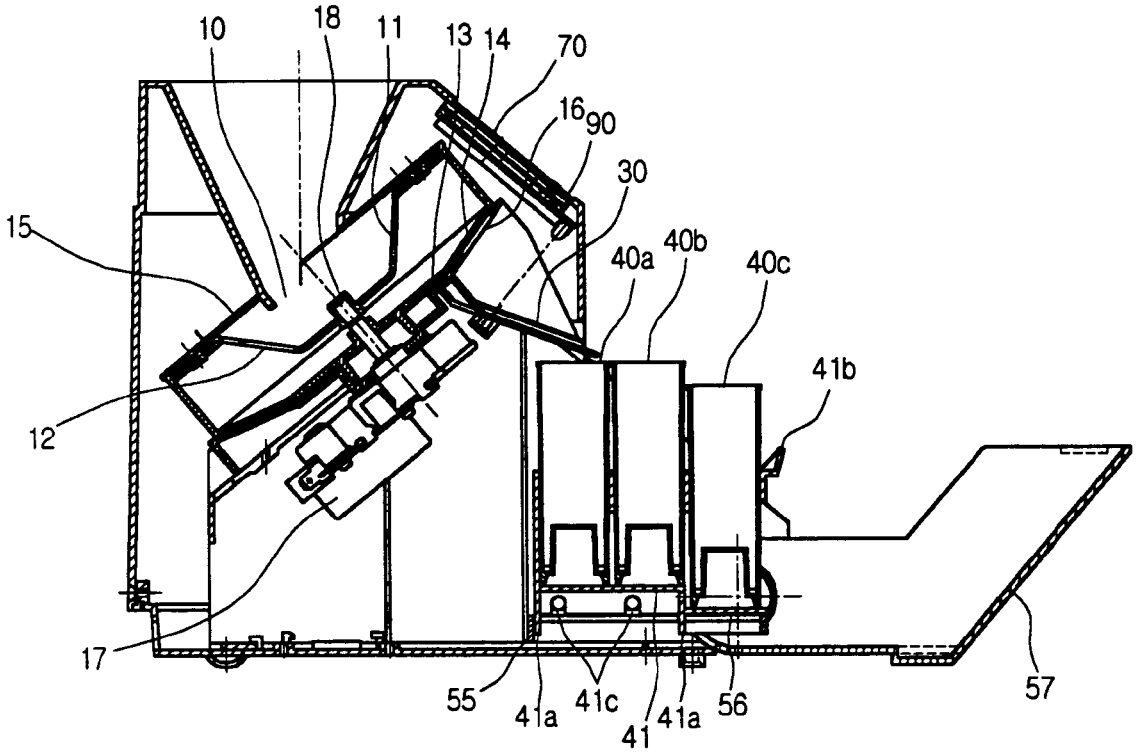
FIG. 4 is a sectional view of a coin sorting apparatus according to a preferred embodiment of the present invention.

FIG. 4 shows a more detailed structure of the coin sorting apparatus according to a preferred embodiment of the present invention.

As shown in the drawing, the coin sorting apparatus further comprises a supply control container 11 provided with supply holes 12 formed at a side portion thereof to supply the coins input from the coin slot 10 into a separating device little by little; a cover 15 for preventing the coins from escaping when the supply control container rotates; a carrier container 13 for carrying the coins supplied through the supply holes 12 so that the coins can be separated by a plurality of carrier holes 14 and separation holes 16; a rotational shaft for rotating the supply control container 11 and the carry container 13; and a motor 17 for driving the rotational shaft 18.

The coin sorting apparatus further comprises first sensing means 90 formed on side portions of the guides 30 receiving the coins separated through the separation holes 16; first, second, and auxiliary coin receiving tubes 40*a*, 40*b*, and 40*c* for receiving the coins supplied from the guides according to the size of the coins; and a receiving container 41 for receiving the first, second, and auxiliary coin receiving tubes 40*a*, 40*b*, and 40*c*. A sliding member 55 is disposed below the receiving container 41 to slidably and pivotally support the receiving container 41, the sliding member 55 being provided with a sliding groove 56 formed in a drawing direction to allow the receiving container 41 to be easily withdrawn and inserted and to prevent the receiving container 41 from being withdrawn and inserted more than a predetermined distance, the receiving container 41 being provided at a lower portion thereof with a sliding projection 41*a* engaged with the sliding groove 56 and a second sensing hole 41*c*.

The first, second, and auxiliary coin receiving tubes 40*a*, 40*b*, and 40*c* are designed in an identical size to receive an identical size of coins. The first, second, and auxiliary coin receiving tubes 40*a*, 40*b*, and 40*c* are received in a single receiving container 41. Therefore, plural containers for each size of coins are provided.

In addition, the receiving container 41 is further provided at a side portion thereof with a handle 41*b* for the convenience of withdrawal and insertion operations of the receiving container 41.

The front cover 57 is provided to prevent the apparatus from being damaged when the apparatus is transported and stored.

The operation and constitution of each part of the coin sorting apparatus will be described in more detail hereinafter.

As an overall constitution of the coin sorting apparatus is shown in FIG. 4, FIG. 4 will always be referred to while other FIGS. are described.

First, the coin separating means will be described.

Figure 5:
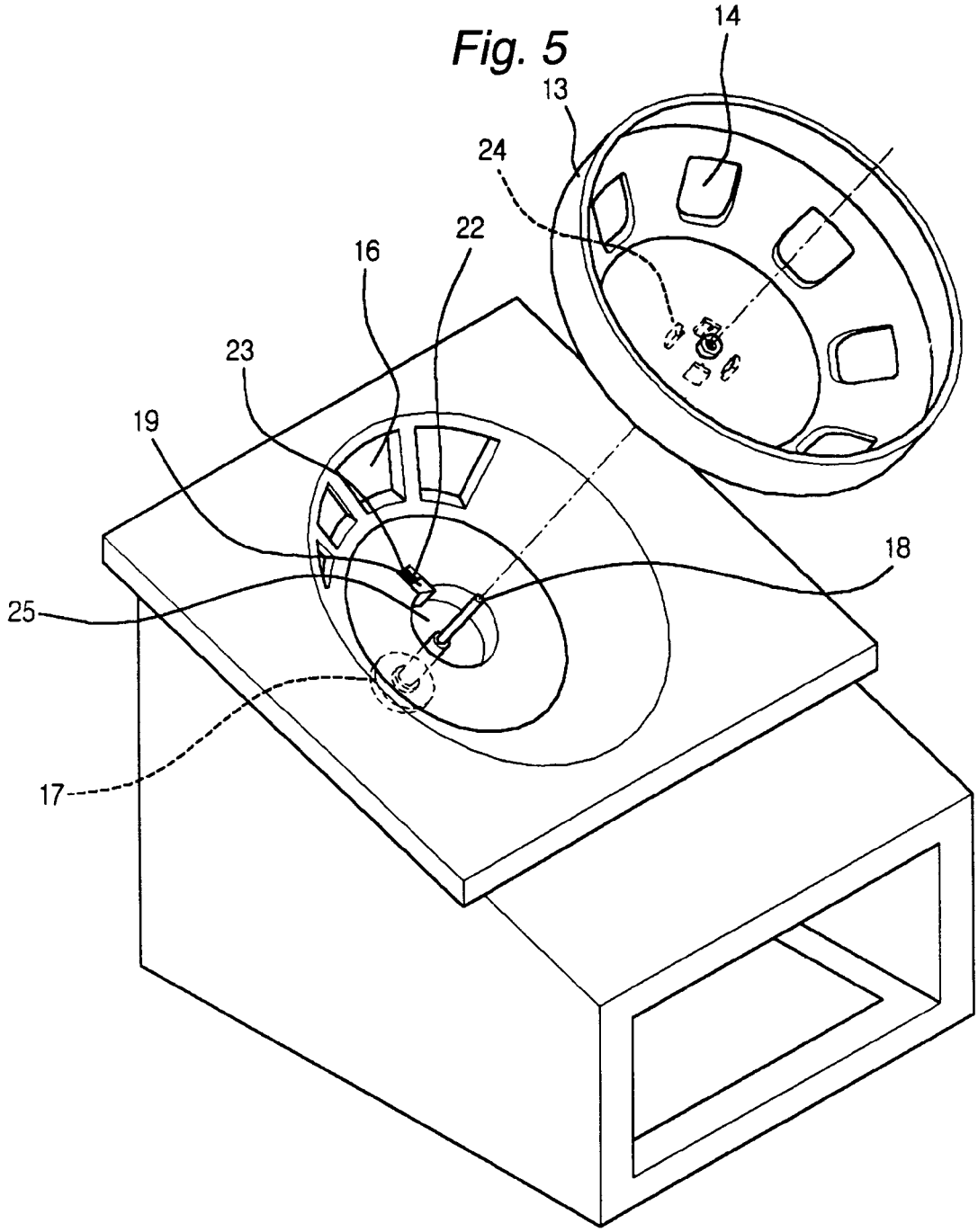
FIG. 5 is an exploded perspective view of coin sorting means according to the present invention.

FIG. 5 shows the coin separating means.

As shown in the drawing, the coin separating means is comprised of the bi-directional motor 17; the rotational shaft 18 driven by the motor 17; a stopper 19 disposed spaced apart from the rotational shaft 18 to prevent the rotational shaft 18 from rotating beyond a predetermined angle; a spring 23 biasing the stopper 19, the carrier container 13 provided at a side portion thereof with carrier holes through which the coins are carried one by one, the carrier container 13 being coupled on the rotational shaft 18, the carrier container 13 being further provided at a lower side thereof with a panel-shaped rotational guide portion 24 for stopping the rotation of the carrier container 13 when the carrier container is inversely rotated over a predetermined angle, the panel-shaped rotation guide portion 24 being concave outward based on the rotational shaft 18; and a separation part provided with a plurality of separation holes 16 having different sizes and corresponding with the carrier holes 14 formed on the carrier container 13.

Provided outside the separation hole 16 are the guides 35 for allowing the sorted coins to be stacked at a predetermined location.

It is preferable that the supply control container 11 provided at a side portion therewith with the supply holes 12, through which the coins are fed to the carrier container 13 little by little, is disposed on the carrier container 13 and rotatably coupled on the rotational shaft 18.

It is further preferable that the supply control container 11 is covered with the cover 15 that is disk-shaped and provided at a central portion thereof with the coin slot 10, thereby preventing the coins from overflowing or escaping therefrom.

The motor 17 is rotatable bidirectionally. For instance, when the motor 17 is not further rotated by an external force in the course of rotating forward (clockwise), the rotational direction of the motor 17 changes into an opposite direction, i.e., reverse (counterclockwise) direction. When the motor 17 is not further rotated by an external force in the course of rotating inversely (counterclockwise), the rotational direction of the motor 17 changes into an opposite direction, i.e., forward (clockwise) direction.

There is provided reverse rotation-prevention means spaced apart by a predetermined distance from the rotational shaft 18. The reverse rotation-prevention means comprises the stopper 22 mounted on a housing 22 and biased by the spring 23. The stopper 19 has an inclined front end. The elastic force and the inclined front ends are designed such that the stopper 19 cannot disturb the rotation of the carrier container 13 in the course of its rotation in the forward (clockwise) direction, while preventing the carrier container 13 from rotating in the reverse (counterclockwise) direction beyond a predetermined angle as the rotation guide portion 24 formed on a lower side of the carrier container 13 is hooked on the stopper 19 in the course of its rotation in the reverse (counterclockwise) direction.

As described above, it is preferable that the rotation guide portion 24 is designed being rounded outward based on the rotational shaft 18 so as to prevent the carrier container 13 from inversely rotating over a predetermined angle while not disturbing the forward rotation of the carrier container 13.

It is further preferable that a supporting portion is provided to securely couple the rotational guide portion 24.

It is further preferable that a rotation guide seating portion 25 for allowing the rotation guide portion 24 to smoothly rotate is formed on the carrier container 13.

Further preferably, the rotation guide portion 24 is provided in plural as 3-8 units.

The separation holes 16 are increased in their sizes as they go in the forward (clockwise) direction. The coins are sorted according to size as the carrier container 13 rotates forward.

That is, since the sizes of the separating holes 16 are gradually increased in the clockwise indirection, if the coin sorting is performed as the carrier container 13 continues to rotate inversely (counterclockwise), a small sized coin may be sorted through the separation hole 16 having a size greater that the small sized coin.

Accordingly, the stopper 19 having the inclined front end and the rotation guide portion 24 are provided to prevent the carrier container 13 from inversely rotating beyond a predetermined angle. That is, as the stopper 19 is caught by the rotation guide portion 24 in the course of the inverse rotation of the carrier container 13, the carrier container 13 cannot further rotate over the predetermined angle.

As the number of rotational guide portions 24 arranged in a circular direction are 3-8, the carrier container 13 rotates forward (clockwise) after it rotates inversely by 30-120°. That is, when the number of rotational guide portions 24 are 4 as shown in the drawing, the carrier container 13 is stopped by the stopper 19 when it rotates inversely by 90°, after which it rotates forward. Likewise, when the number of rotational guide portions 24 is 8, the carrier container 13 is stopped by the stopper 19 when it rotates inversely by 45°, after which it rotates forward.

Accordingly, if the coin is held between the carrier hole 14 and the separation hole 16 and thereby the rotation of the carrier container 13 is stopped, the carrier container 13 rotates inversely by a predetermine angle in accordance with the number of the rotation guide portions 24 to remove the held coin, after which the carrier container 13 rotates again forward to sort the coins.

Figure 6:
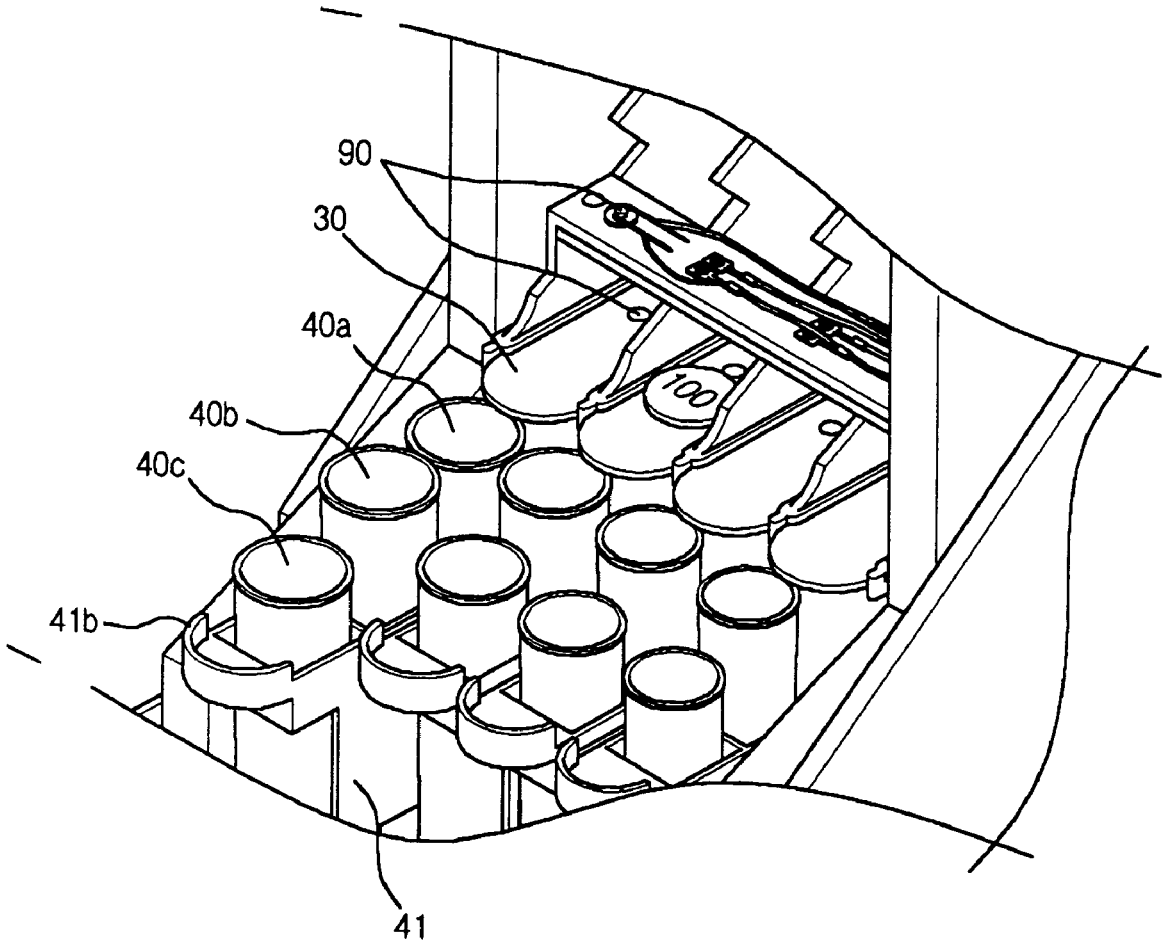
FIG. 6 is a partial perspective view of first sensing means of a coin sorting apparatus according to the present invention.

FIG. 6 shows first sensing means of the coin sorting apparatus according to the present invention.

As shown in the drawing, the first sensing means 90 is preferably located on upper and lower portions of the guides 30, and is also preferably formed of optical sensors. However, the present invention is not limited to the optical sensors.

The upper and lower sensors of the first sensing means 90 are designed to give signals to each other and to interrupting the signals at the moment when a coin passes through the guide 30, thereby counting the number of coins being received. That is, the sensing means 90 detects a surface of the coin sliding along the guide to enhance the sensing reliability.

Accordingly, as the sensing means 90 is provided on upper and lower portions of the guide 30 for classifying and receiving the coins by size, the number of coins received can be accurately counted.

If the sensing means 90 is disposed on central upper and lower portions of the guide 30 and two independent coins consecutively slide along the guide in a state where they contact each other, the sensing operation may not be accurately realized. Therefore, it is preferable the sensing means 90 is disposed on upper and lower portions of the guide 30.

By the first sensing means 90 detecting the number of coins received in the coin receiving tube 40*b*, when a predetermined number of coins are received in the coin receiving tube 40*b*, the operation of the coin sorting apparatus is stopped by the control operation of the control/display part 70. Here, the predetermined number of coins can be preset to an extent where the sorted coins can be easily wrapped up.

For example, when the first sensing means detects that the number of coins received in the second coin receiving tube 40*b* is 50, the operation of the apparatus is stopped. When the user pulls the handle 41*b* of the receiving container 41 to an extent where the first coin receiving tube 40*a* can receive the coins, the apparatus starts its operations again.

At this point, when the predetermined number of coins is received in the coin receiving tube 40*b*, the speaker makes a sound letting the user know the operation state of the apparatus.

The second coin receiving tube 40*b* filled with the predetermined number of coins is taken out of the apparatus for the user to wrap up the sorted coins for use.

Figure 7:
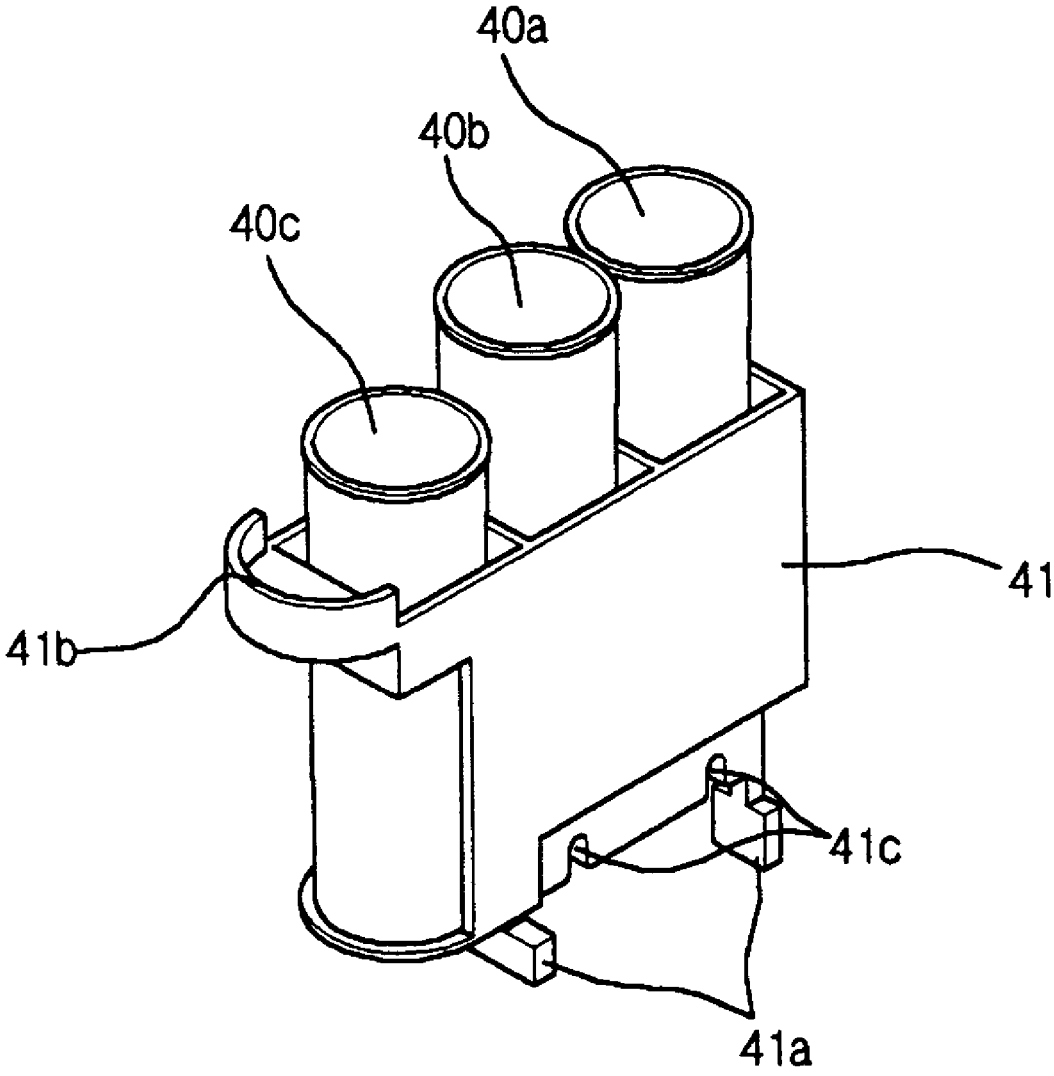
FIG. 7 is a perspective view of coin receiving tubes and a coin receiving container of a coin sorting apparatus according to the present invention.

FIG. 7 shows the coin receiving tubes and the receiving container of the coin sorting apparatus of the present invention.

As shown in the drawing, the first, second, and auxiliary coin receiving tubes 40*a*, 40*b*, and 40*c* are received in the receiving container 41. The handle 41*b* is formed on a portion of the receiving container 41.

The first, second, and auxiliary coin receiving tubes 40*a*, 40*b*, and 40*c* are provided at tops thereof with circumferential projections so that the user can easily take the tubes out of the receiving container 41. That is, when the tubes are fully filled with the coins, it is not easy for the user to take them out of the container 41 due to their increased weight. Therefore, by forming the circumferential projections, the user can take the tubes 40*a*, 40*b* and 40*c* out of the receiving container without slipping on the surfaces of them.

In addition, the receiving container 41 is provided at a lower side thereof with the sliding projections 41*a* and the second sensing holes 41*c*. The sliding projections 41*a* are engaged with the sliding members 55 to allow the receiving container 41 to slidably move forward and rearward. The second sensing holes 41*c* are provided to detect if the receiving container is located at a position where it can appropriately receive the coins.

Figure 8:
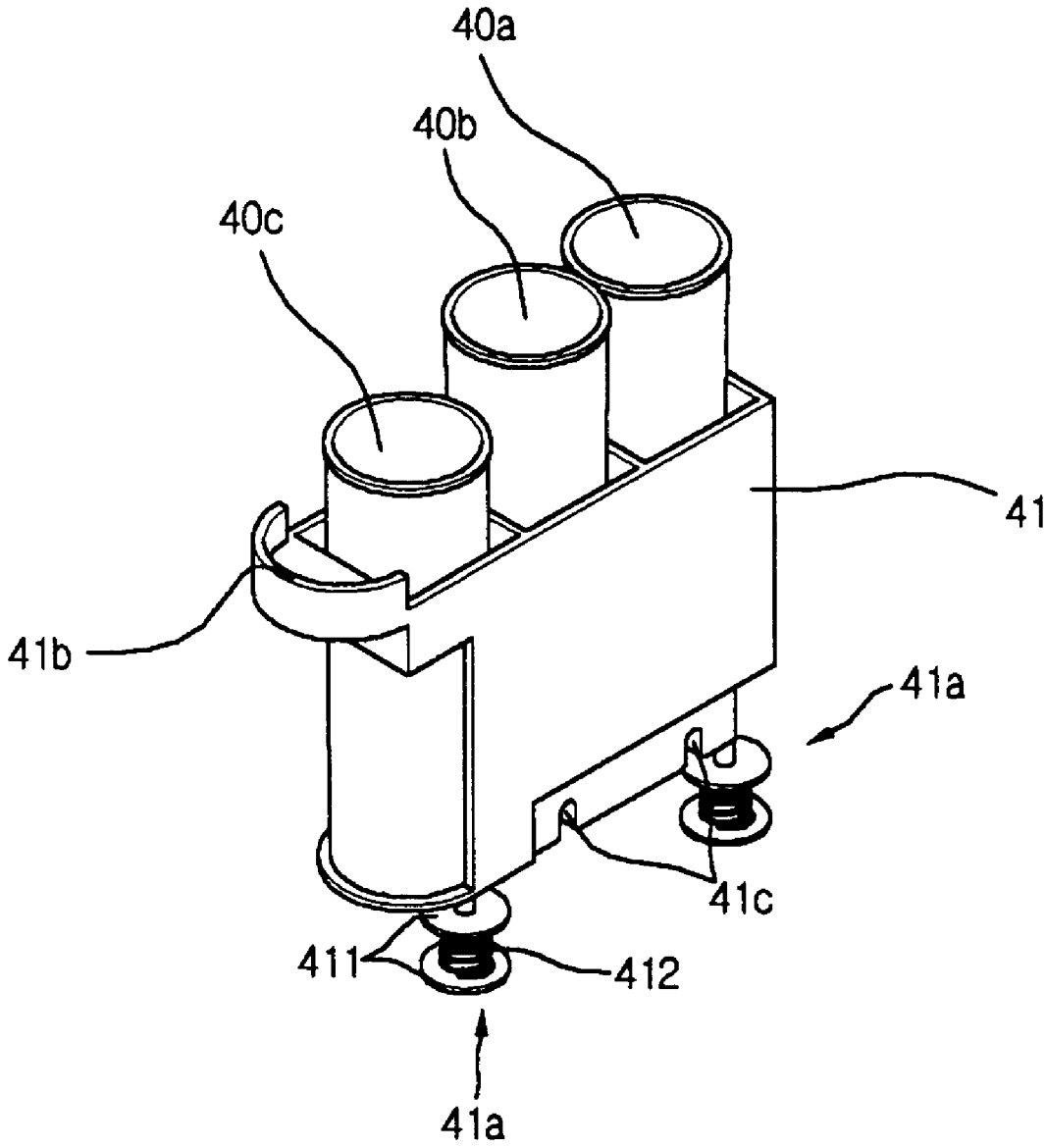
FIG. 8 is a perspective view illustrating a modified example of a sliding projection of a coin sorting apparatus according to the present invention.

The sliding projections 41*a* are designed such that the receiving container 41 linearly slides without separating from sliding member 55, and creates a predetermined friction force so that the receiving container 41 does not move when the receiving container 41 slides and is fixed at a predetermined position. FIG. 8 shows a modified example of the sliding projections.

As shown in the drawing, each of the sliding projections 41*a* of this modified example is comprised of an extending portion formed extending downward from the receiving container 41, upper and lower plates 411 disposed around the extending portion, and an elastic member 412 formed around the extending portion between the plates 411.

The elastic member 412 biases the plate 411 upwards so that friction force can be created between the upper plate 411 and the bottom of the sliding member 55. Accordingly, even when the user unintentionally applies a small force, the receiving container 41 is not displaced. Although the sliding projections 41*a* are formed on both lower sides of the bottom of the receiving container 41, it is also possible to provide only one sliding projection.

The number of the receiving containers 41 corresponds to the number of denominations of coins, and the sizes of the first, second, and auxiliary coin receiving tubes 40*a*, 40*b*, and 40*c* contained in a first receiving container are designed to receive first coins having an identical size to each other. A second container for receiving second coins having a size identical to each other but different from that of the first coins is provided separate from the first container.

Figure 9:
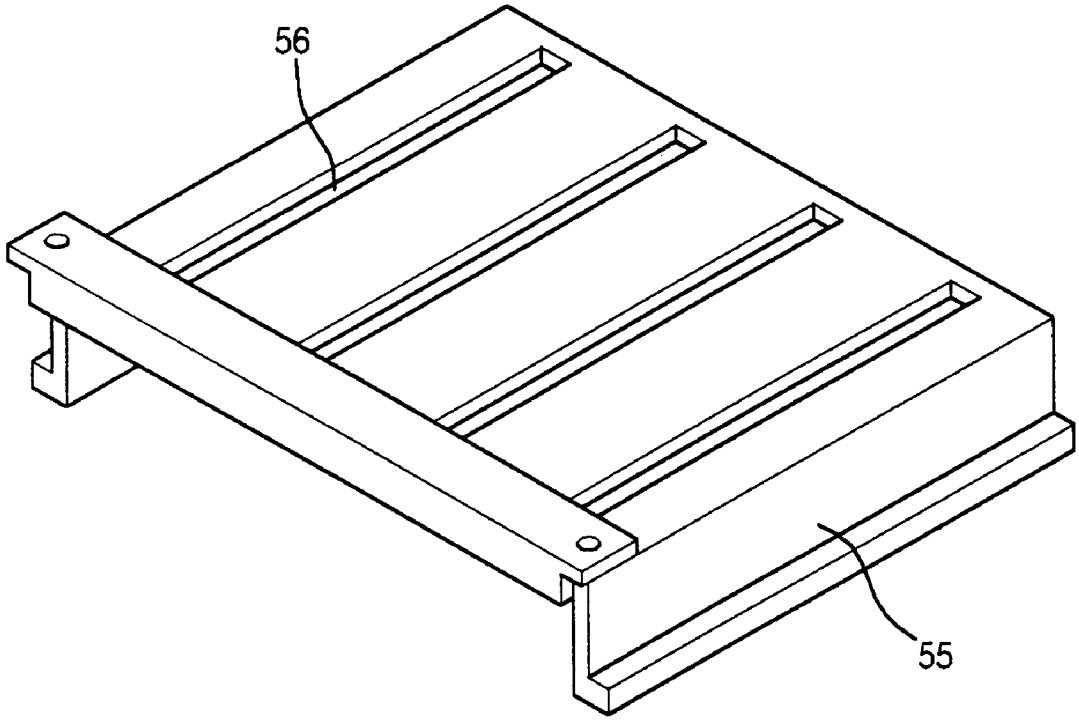
FIG. 9 is a sliding member coupled to a receiving container depicted in FIG. 7.

FIG. 9 shows the sliding member coupled to the receiving container.

As shown in the drawing, the sliding member 55 is coupled to the sliding projections 41*a* of the receiving container 41 such that it can linearly slide with respect to the receiving container 41. That is, the sliding member 55 is provided with sliding grooves 56 in a direction where it slides.

Figure 10:
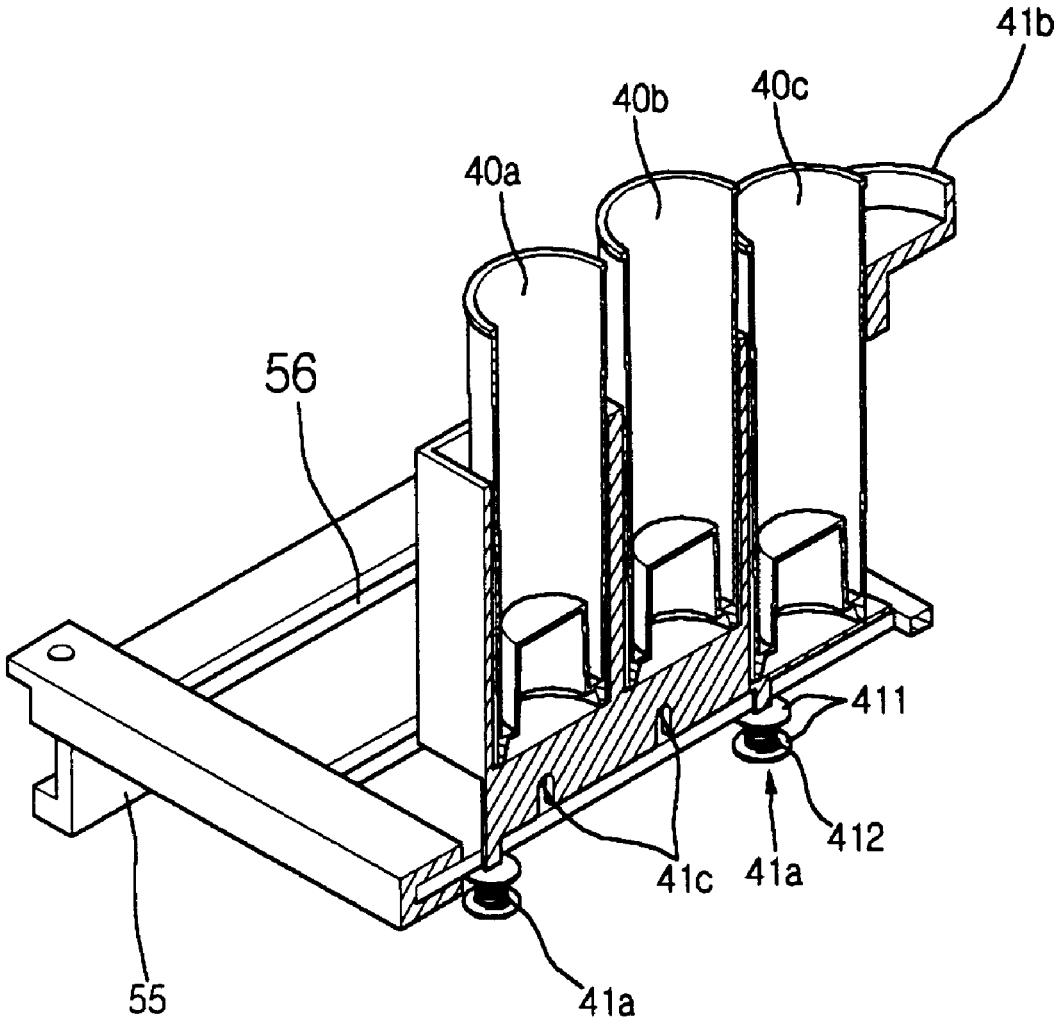
FIG. 10 is a perspective view illustrating a coupling state of a receiving container for first and second coin receiving tubes and a sliding member according to the present invention.

FIG. 10 shows the receiving container coupled to the sliding member.

As shown in the drawing, the sliding projections 41*a* of the receiving container 41 are inserted into the sliding groove 56 so as to linearly slide on the sliding member 55.

Figure 11:
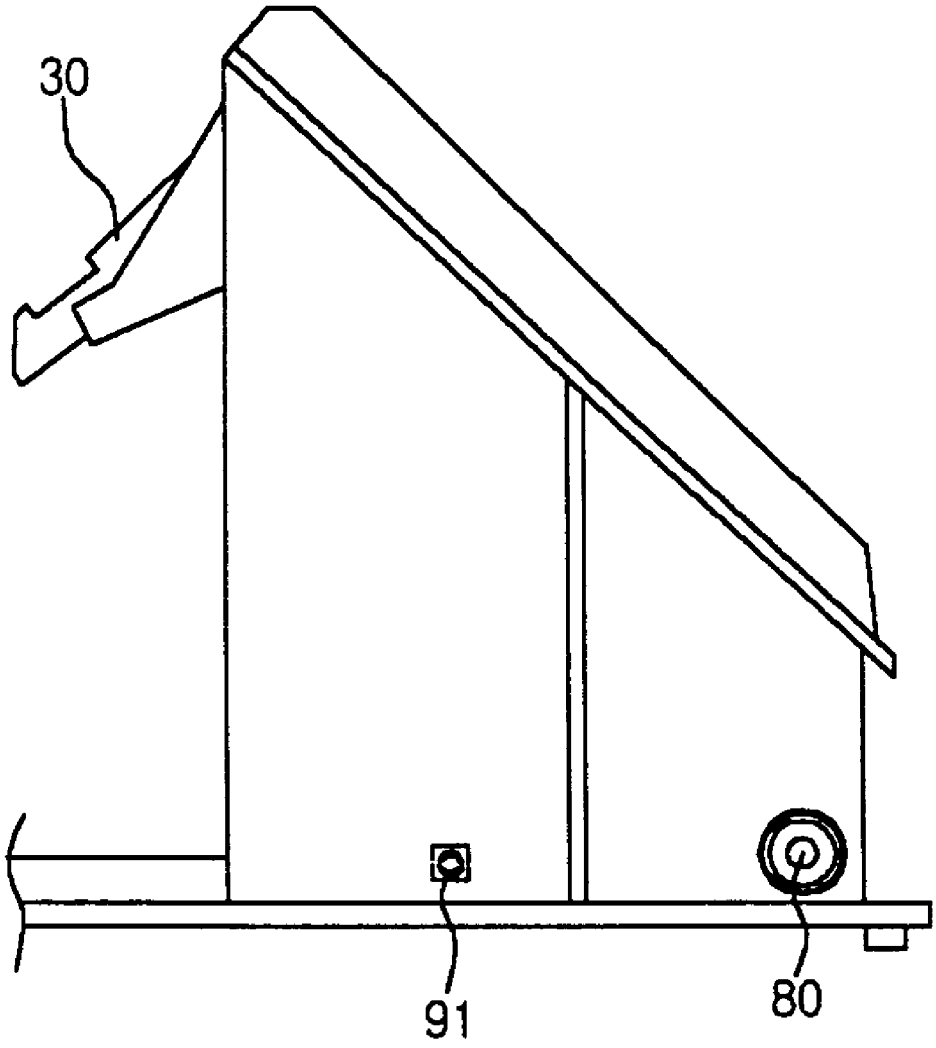
FIG. 11 is a side view illustrating second sensing means and a speaker according to the present invention.

FIG. 11 shows the second sensing means and the speaker portion of the coin sorting apparatus according to the present invention.

In FIG. 11, an internal surface of the coin sorting apparatus is shown.

As shown in the drawing, the second sensing means 92 is comprised of two sensors disposed on opposing inner surfaces of the coin sorting apparatus. The sensors transmit signals to each other to detect a state variation. The second sensing holes 41*c* are located between the sensors to correspond to the sensors during the operation of the coin sorting apparatus. That is, when the sensing holes 41*c* and the sensors of the second sensing means 91 are aligned to be in-line, it becomes possible for the sensors to transmit signals to each other. This state means that the coin receiving tubes are correctly located at a location where they can appropriately receive the coins.

In addition, the speaker portion 80 is formed on a portion of the coin receiving apparatus to make a variety of sounds in accordance with the operation states of the apparatus, thereby letting the user identify the operation states by the sounds.

As described above, the operation states of the coin sorting apparatus can be detected by the first and second sensing means 90 and 91, the operation of which can be controlled by a control system.

Figure 12:
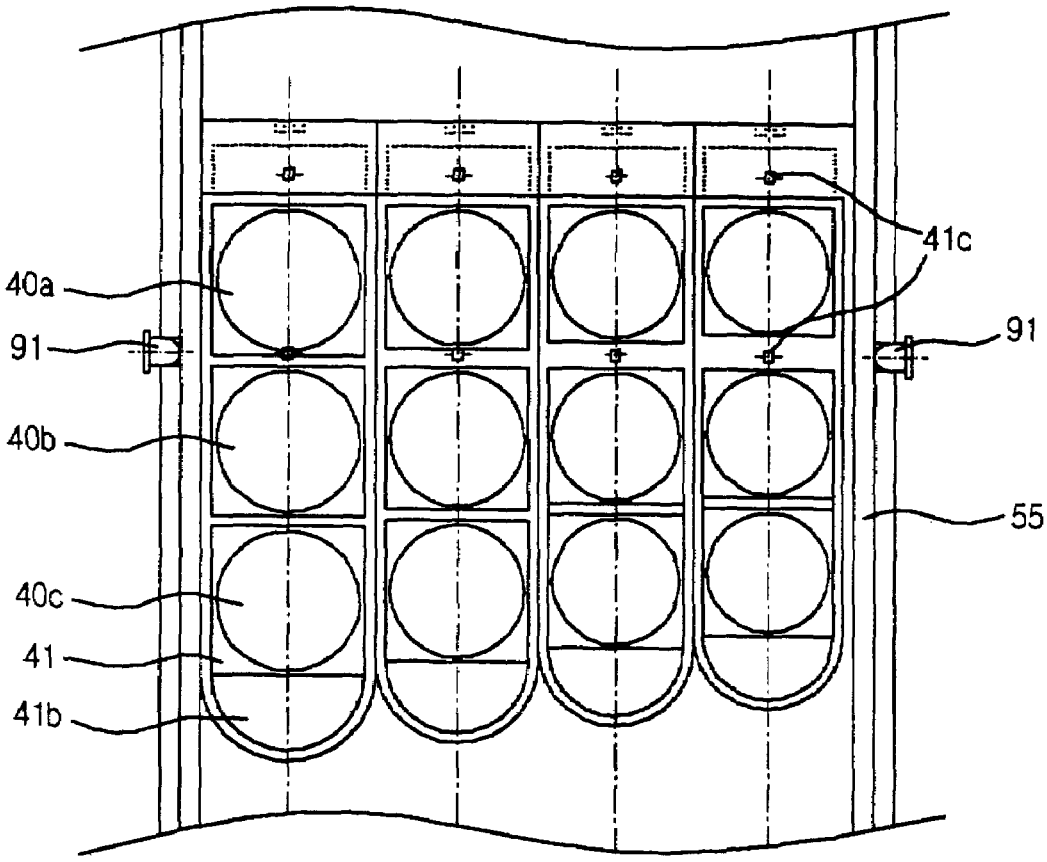
FIG. 12 is a plane view illustrating a location of coin receiving tubes and second sensing means according to the present invention.
Figure 13:
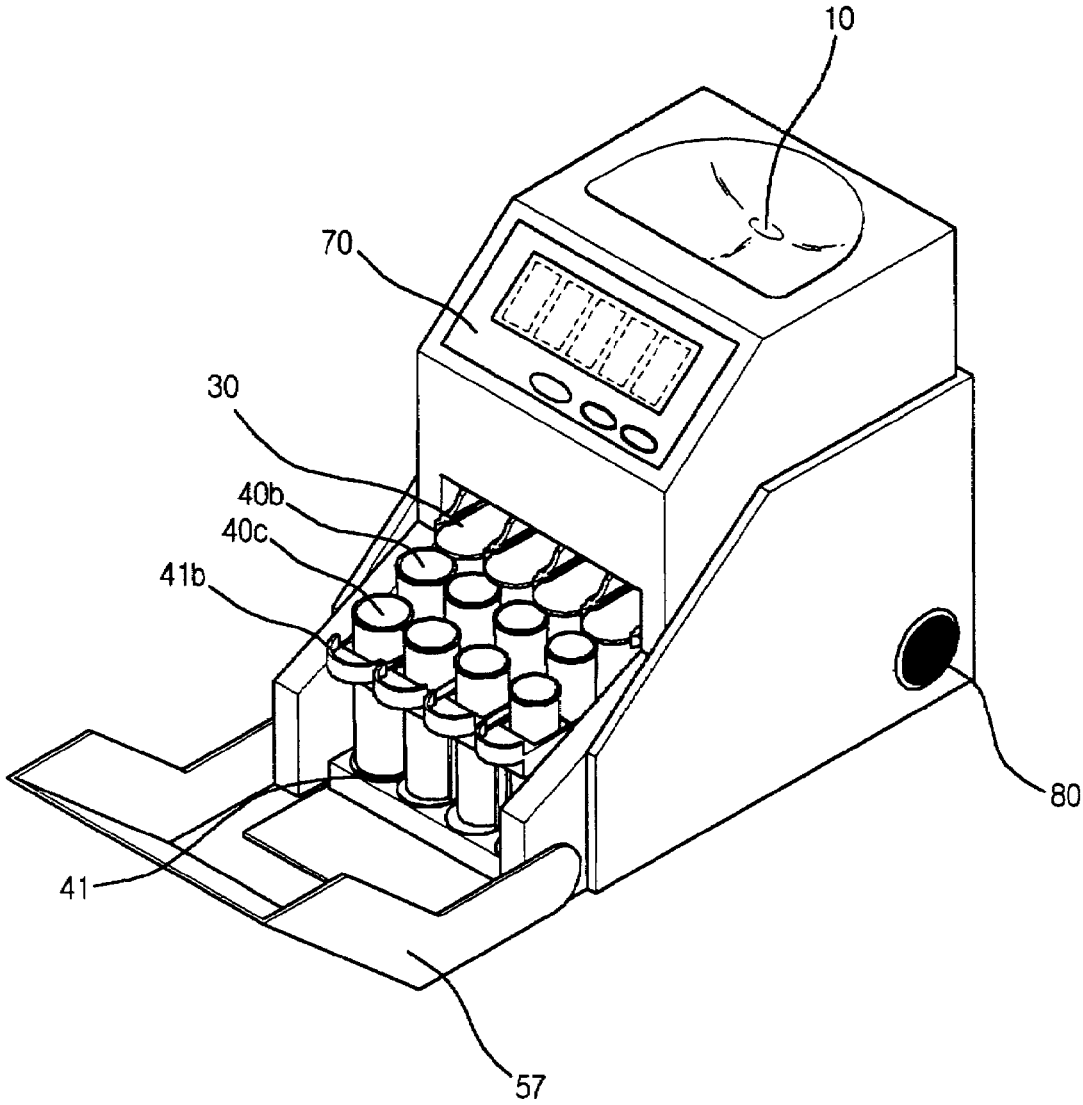
FIG. 13 is a perspective view illustrating a location of coin receiving tubes and second sensing means according to the present invention.

FIGS. 12 and 13 show a relative location of the coin receiving tubes and the second sensing means according to the present invention.

As shown in the drawings, the first, second, and auxiliary coin receiving tubes 40*a*, 40*b* and 40*c* are received in each of the receiving containers 41. Each of the receiving containers 41 is provided at a lower side thereof with the two sensing holes 41*c*.

The two sensing holes 41*c* are spaced apart from each other by a predetermined distance that is identical to a moving distance of the first and second coin receiving tubes 40*a* and 40*b* to the location where the tubes can appropriately receive the coins.

The state shown in the drawing is an initial coin sorting stage, in which the sensors of the second sensing means 91 and the second sensing holes 41*c* are aligned to be in-line.

Accordingly, it can be possible for the sensors of the second sensing means to transmit the signals to each other. This means that the first and second coin receiving tubes 40*a* and 40*b* are properly located on the correct location for receiving the coins.

This state is shown in FIG. 13.

That is, in this state, the coins are received in the second coin receiving tubes 40*b*, and the first receiving tubes 40*a* are located inside with respect to the guides 30.

Figure 14:
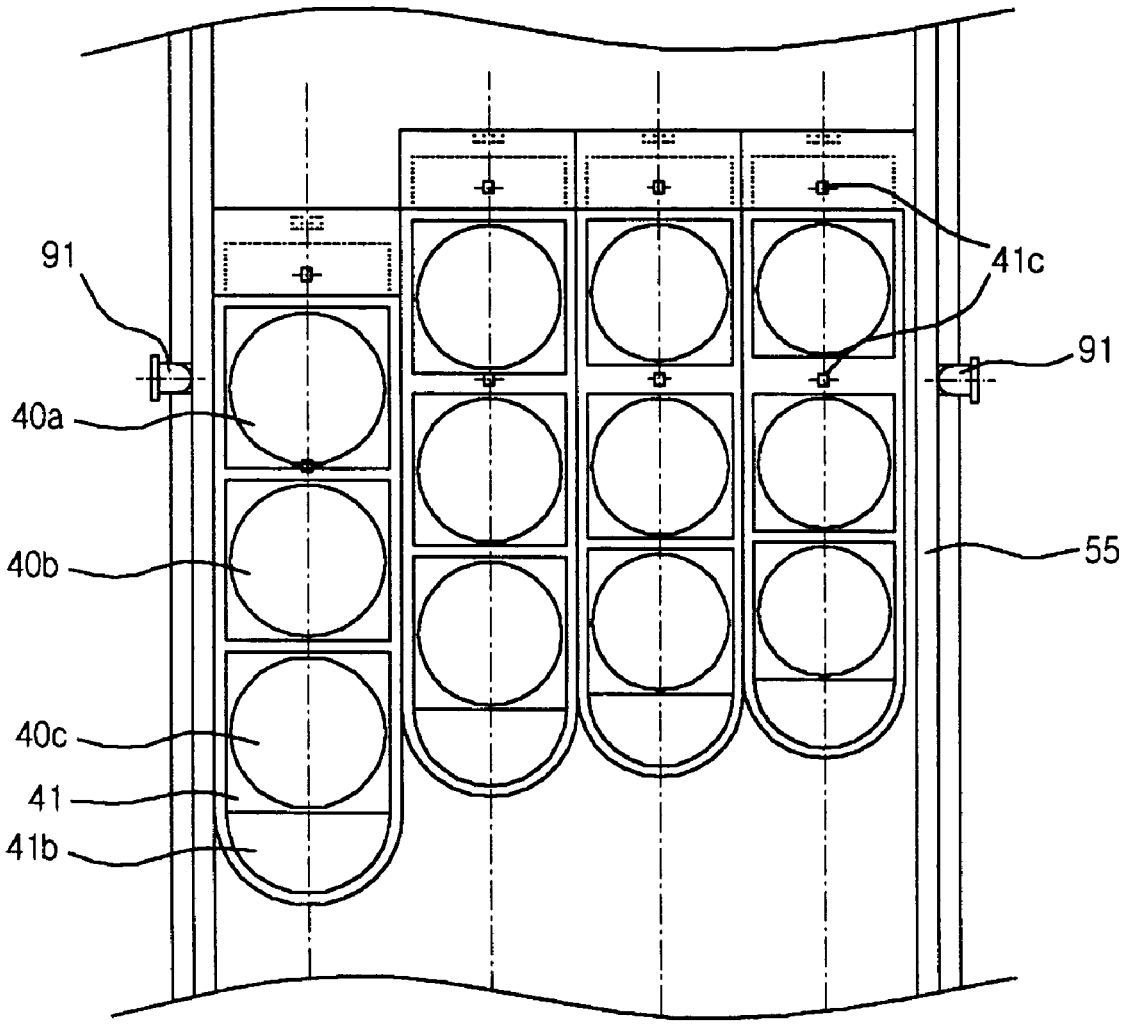
FIG. 14 is a plane view illustrating a process for locating a first coin receiving tube under a guide by pulling a receiving container when a predetermined number of coins are filled in a second coin receiving tube.
Figure 15:
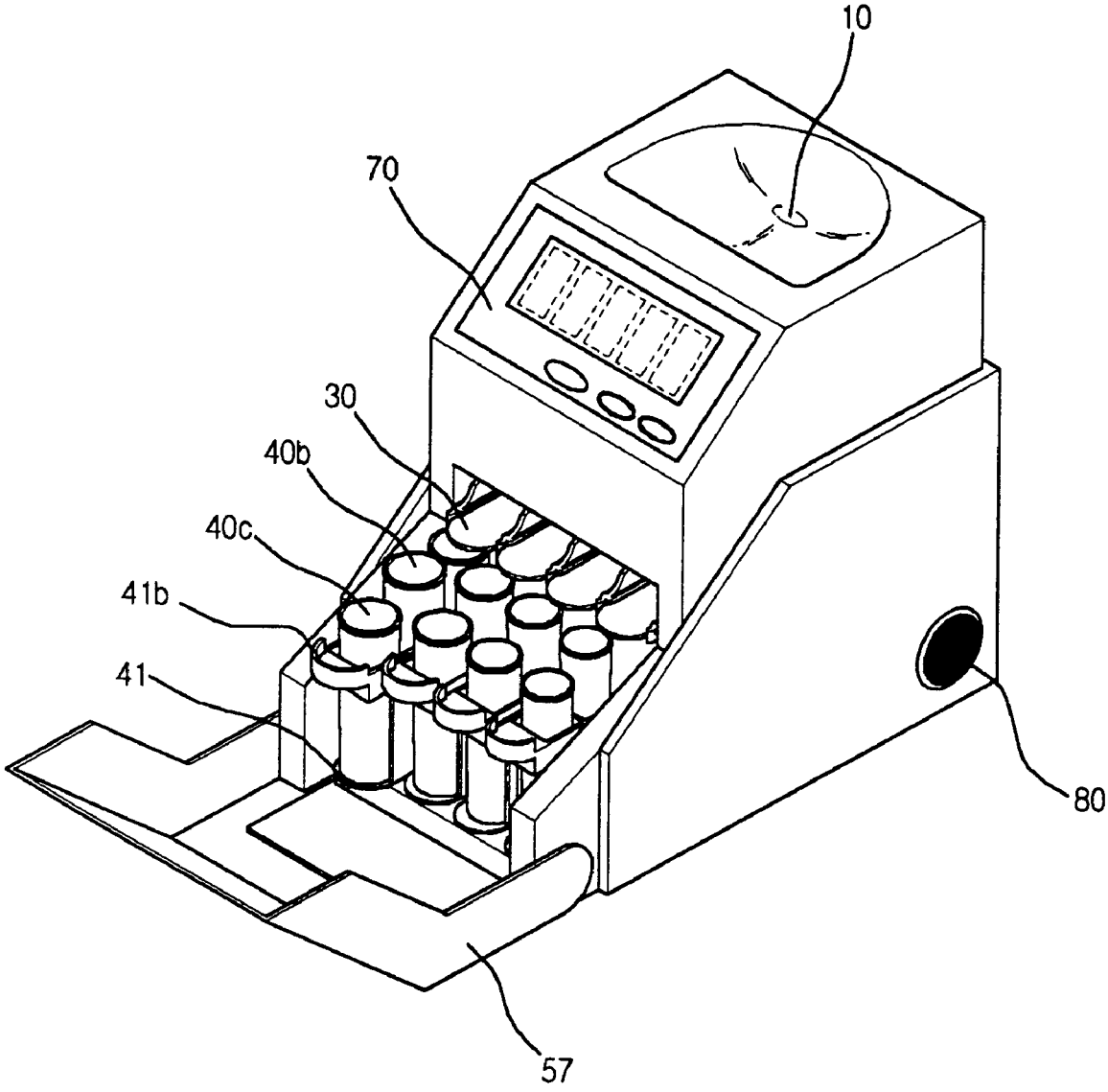
FIG. 15 is a perspective view illustrating a process for locating a first coin receiving tube under a guide by pulling a receiving container when a predetermined number of coins are filled in a second coin receiving tube.

FIGS. 14 and 15 show a process for moving the first coin receiving tube 40*a* to a location under the guide when the second coin receiving tube 40*b* is filled with the predetermined number of coins.

When the second coin receiving tube 40*b* is filled with the predetermined number of coins, the operation of the coin sorting apparatus is stopped by the first sensing means and the control system. When the user pulls the handle 41*b* to locate the first coin receiving tube 40*a* under the guide 30, the second sensing means detects it and the apparatus starts its operation again.

FIG. 14 shows a state where the second sensing holes 41*c* are moved with the movement of the receiving container 41 and the signal transmission between the sensors of the second sensing means 91 is interrupted.

FIG. 15 shows a state where the second coin receiving tube 40*b* is moved to a location where it cannot appropriately receive the coins.

As described above, by forming the sensors at the predetermined locations, it becomes possible to stop the operation of the coin sorting apparatus when the first and second coin receiving tubes 40*a* and 40*b* are located at a location where they cannot properly receive the coins.

Although three coin receiving tubes are provided in each of the receiving containers in this embodiment, it is also possible that only one coin receiving tube is provided in each of the containers according to the size of the coins, and the second sensing means 91 is equipped on each tube to control the operation of the apparatus. In this case, the location of the second sensing means 91 can be modified to a variety of locations.

Figure 16:
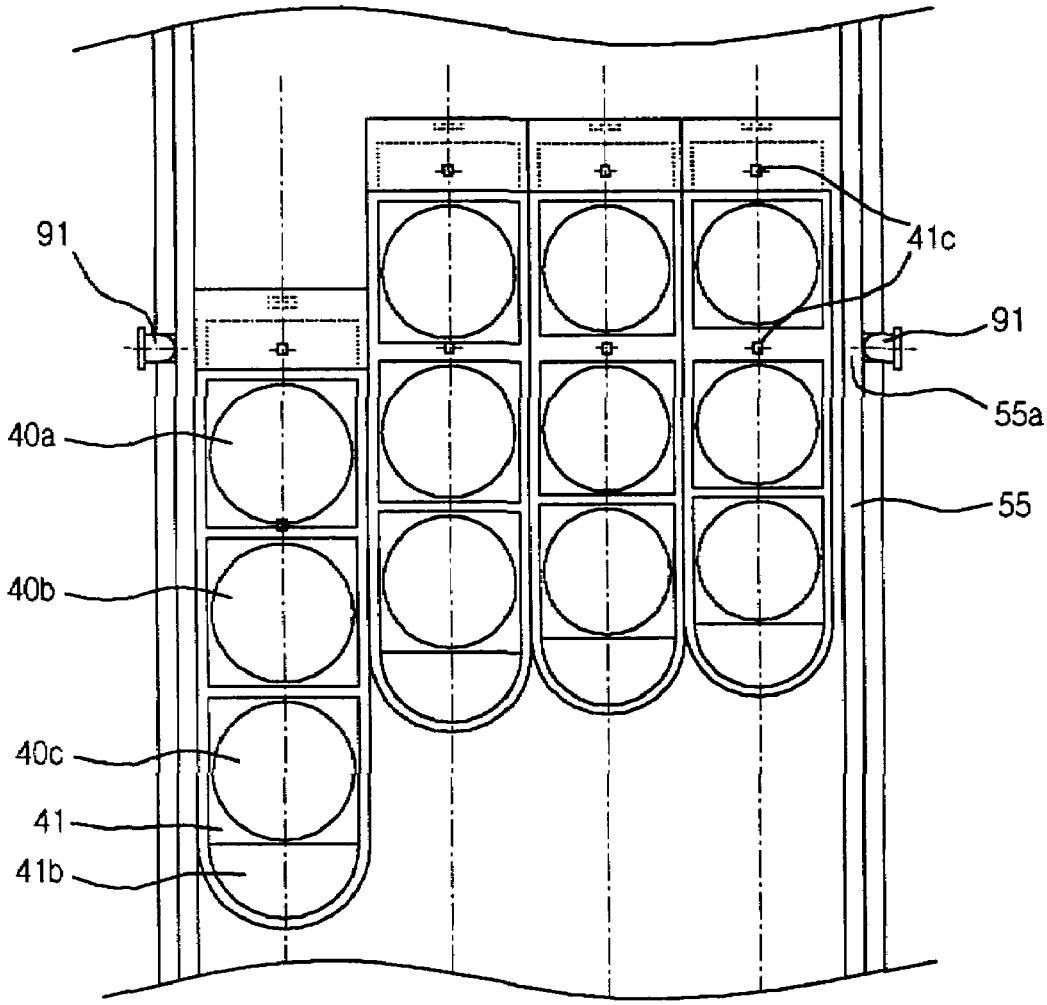
FIG. 16 is a plane view illustrating a state where a first coin receiving tube is located under a guide.
Figure 17:
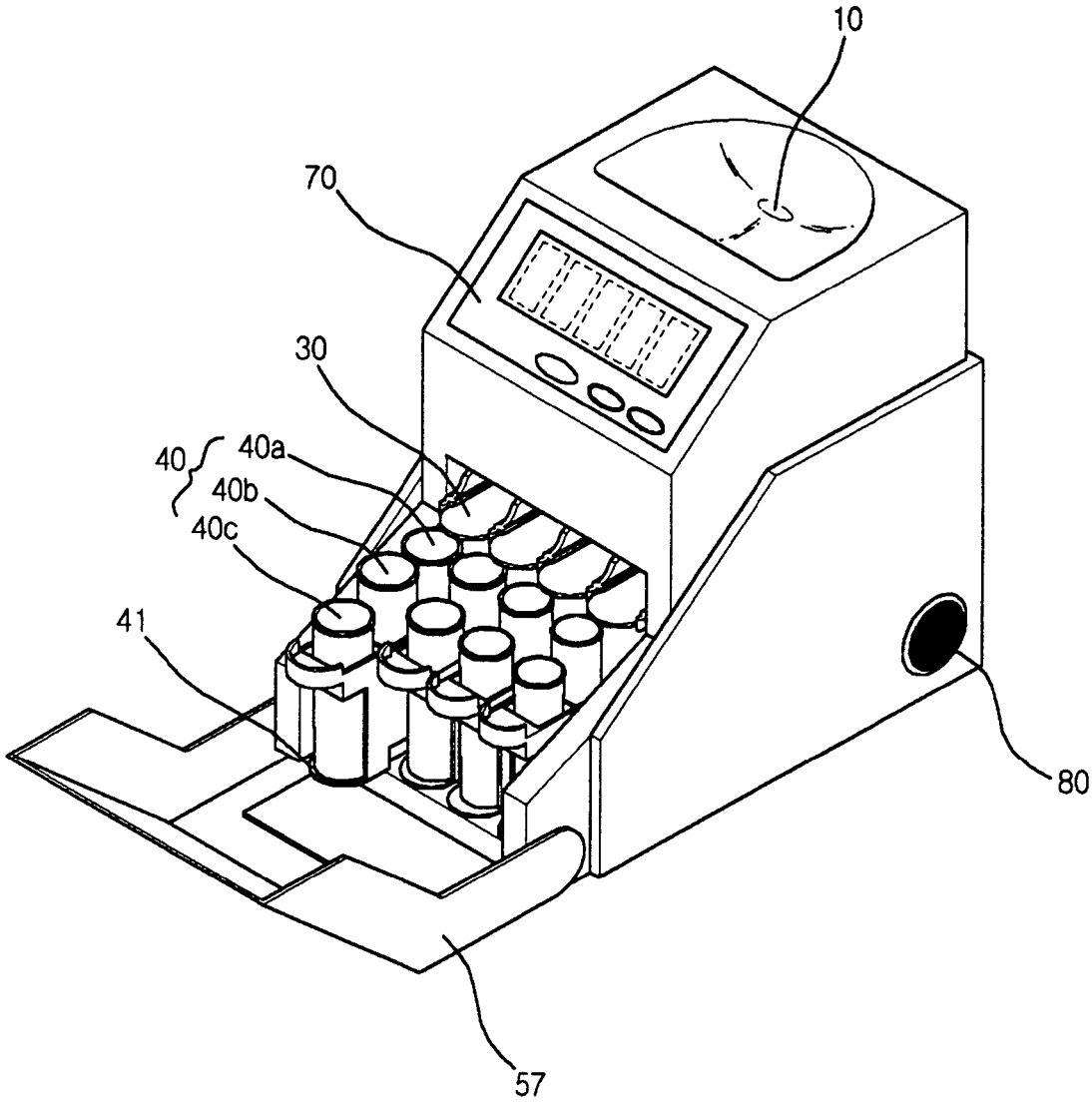
FIG. 17 is a perspective view illustrating a state where a first coin receiving tube is located under a guide.

When the user completely pulls the receiving container 41, the second coin receiving tube 40*b* is withdrawn and the first coin receiving tube 40*a* is located under the guide 30 as shown in FIGS. 16 and 17.

Accordingly, the sensors of the second sensing means 91 and the second sensing holes 41*c* are aligned again to be in-line. As a result, the signal transmission between the sensors starts again to operate the apparatus.

Therefore, it is possible for the user to wrap up the coins received in the second coin receiving tube 40*b* while the coins are continuously received in the first coin receiving tube 40*a*.

In addition, when the first coin receiving tube 40*a* is filled with the coins, the user takes the first coin receiving tube 40*a* out of the receiving container 41 and displaces the auxiliary receiving tube 40*c* to the location for the first coin receiving tube 40*a*.

At this point, the second coin receiving tube 40*b* is also mounted in the receiving container 41 to be the state shown in FIG. 12.

After the coins received in the first coin receiving tube 40*a* are wrapped up, the first coin receiving tube 40*a* is mounted on a location for the auxiliary coin receiving tube 40*c*.

As described above, by utilizing the first, second, and auxiliary coin receiving tubes 40*a*, 40*b*, and 40*c*, the user can more conveniently and quickly sort and wrap up the coins.

Figure 18:
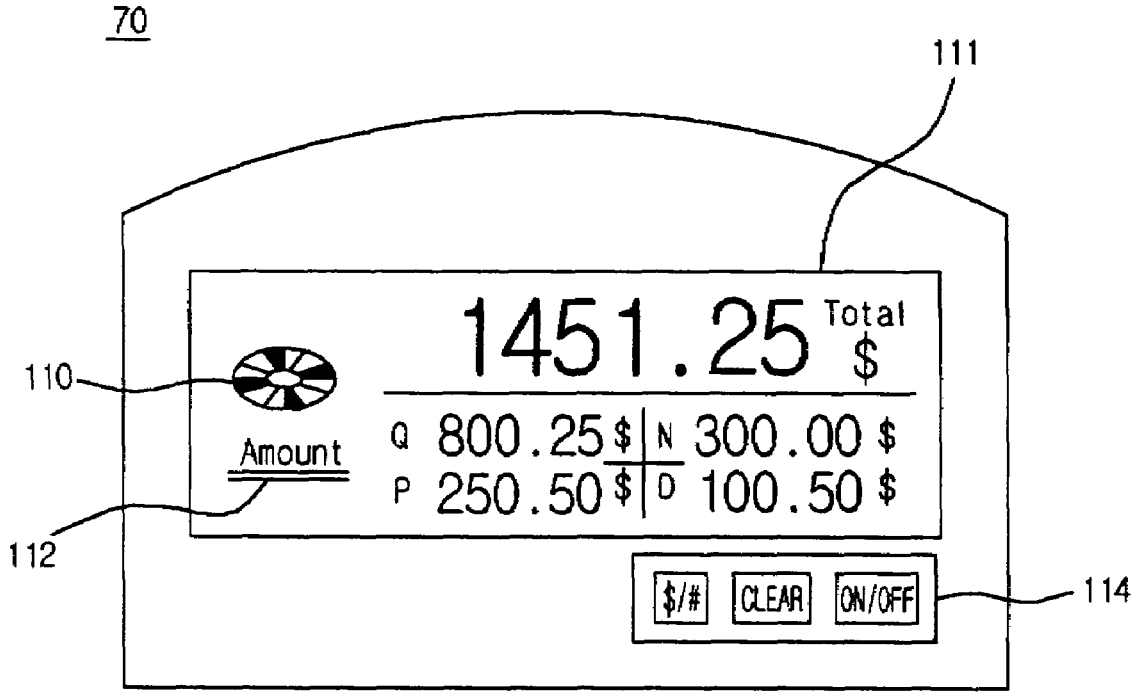
FIG. 18 is a schematic view illustrating a control/display part of a coin sorting apparatus according to the present invention.

FIG. 18 shows the control/display part of the coin sorting apparatus according to the present invention.

As shown in the drawing, a plurality of operation buttons and a display panel are provided. The user can identify if the apparatus is operating or not through a display lamp 110. By manipulating a $/# button of an operation button part 114, the user can identify the amount or number of the sorted coins.

At this point, the amount or number of the sorted coins is displayed on an LCD screen 11. The user also identifies if the currently displayed figure is the amount or the number of the sorted coins through the amount/number display 112. However, since the number of sorted coins is meaningless, the total number of coins is calculated in accordance with the denominations of coins, and only the total amount of the sorted coins are displayed.

In addition, it is preferable that the number of coins is displayed within a predetermined range. That is, if it is preset such that the coins are wrapped in 50*s* and the coin receiving tube 40*b* is designed for receiving 50 coins, when the coin receiving tube 40*b* is filled with 50 coins, the operation of the apparatus is stopped. When the user pulls the receiving container so that the coin receiving tube 40*a* receives the coins, the apparatus starts its operation again. At this point, the amount of the coins to be displayed is the sum of the 50 sorted coins and the coins currently being sorted. However, the number of coins is counted from "0."

The above-described functions allows the user to foresee the operation of the coin sorting apparatus and to easily identify the number of sorted coins even when the operation of the apparatus is stopped in a state where the coin receiving tube is not fully filled with the coins.

The display can be realized in a variety of methods. For example, the numerals from "0" to "50" can be sequentially displayed or the number of coin receiving tubes filled with 50 coins can be also displayed. Describing FIG. 17 as an example, when the coin receiving tube 40*b* is fully filled with 50 coins and the coin receiving tube 40*a* is filled with 23 coins, the 50 coins in the coin receiving tube 40*b* can be displayed as "1," and the 23 coins in the coin receiving tube 40*a* can be displayed as "23." At this point, the numerals "1" and "23" are distinguishably displayed for the user.

That is, it is preferable that the number of coins being received in the coin receiving tube 40*a* in the course of the operation of the coin sorting means and the number of coins received in the coin receiving tube 40*a* when the operation of the coin sorting means is stopped can be distinguishably displayed for the user.

In addition, when the sorting operation is completed, by manipulating a CLEAR button, the apparatus is reset by deleting the current data so that a new sorting operation can be possible. There is also provided an ON/OFF button for connecting or cutting off the power to or from the coin sorting apparatus.

Figure 19:
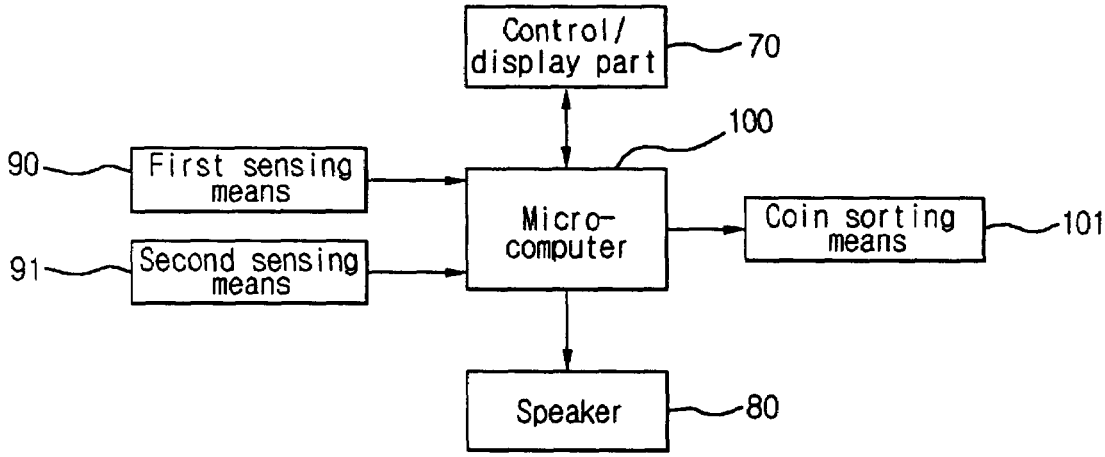
FIG. 19 is a block diagram illustrating a control system for a coin sorting apparatus according to the present invention.

FIG. 19 shows the coin sorting control system for the coin sorting apparatus according to the present invention.

As shown in the drawing, the coin sorting control system is comprised of the first sensing means 90 for detecting the number of coins being sorted according to the size, the second sensing means 91 for detecting the location of the coin receiving tube, a microcomputer 100 for controlling the operation in accordance with the signals from the first and second sensing means 90 and 91, the speaker 80 for making a variety of sounds in accordance with the control of the microcomputer 100 when it is determined by the first sensing means that a predetermined number of coins is sorted, and a control/display part 70 for displaying a current coin sorting state and manipulating the coin sorting apparatus.

In addition, the control/display part 70 has a user interface function so as to allow the user to control the microcomputer by manipulating the buttons and to stop the operation of the coin sorting means 101, while displaying the amount or number of the coins.

Describing in more detail, the first sensing means 90 is provided on the guides 30 to detect the number of coins being sorted according to size, and the detected number of coins is displayed on the control/display part 70. The second sensing means 91 detects if the coin receiving tube is located on a correct location for receiving the coins, and the microcomputer 100 controls the operation of the coin sorting means 101 in accordance with the detected result of the second sensing means 91.

In addition, when the predetermined number of coins is received in the coin receiving tube, the operation of the coin sorting means is stopped. The speaker makes a sound letting the user know the operation stop of the coin sorting means.

Through the control/display part 70, the user can control the coin sorting apparatus and identify the amount and number of sorted coins as well as the operation state of the apparatus.

The microcomputer 100 is designed to display the total amount of coins sorted according to the size and the number of sorted coins within a predetermined range. Here, it is preferable that the predetermined range is set to the number of coins to be received in one coin receiving tube. The number of coins to be received is determined in a unit that can be easily packed, for example, is set in 50.

When the coin receiving tube is filled with 50 coins, the operation of the apparatus is stopped. When the user replaces the coin receiving tube with a new coin receiving tube, the number of coins is counted from "0." That is, the number of coins being received in the coin receiving tube is disposed in a range of "0" to "50." However, the number of coin receiving tubes that have already received 50 coins is distinguishably displayed.

Accordingly, it is possible for the user to immediately identify the number of coins being received in the coin receiving tube 40*a* in the course of the operation of the coin sorting means or the number of coins received in the coin receiving tube 40*a* when the operation of the coin sorting means is stopped.

Figure 20:
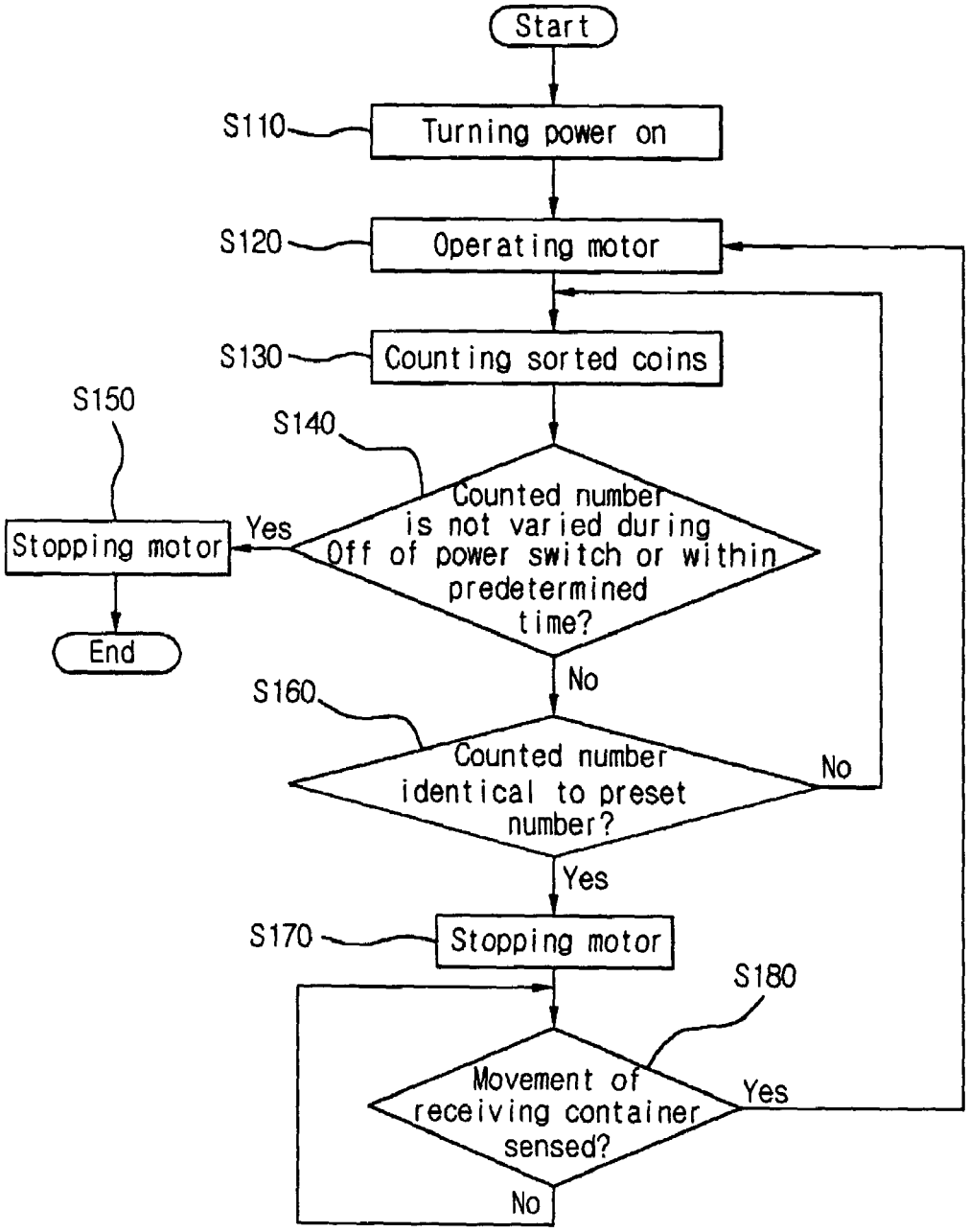
FIG. 20 is a flowchart illustrating the operation of a coin sorting apparatus according to the present invention.

FIG. 20 shows a flowchart illustrating the operation of the coin sorting apparatus according to the present invention.

When the user turns the power on (S110), the motor operates (S120), thereby sorting the coins according to the size through the guides.

At this point, the number of sorted coins is detected by the first sensing means (S130). Then, it is determined if the user turns the power off or the number of sorted coins is not varied for a predetermined time (S140). When the user turns the power off or the number of sorted coins is not varied for a predetermined time, it is assumed that the coin sorting operation is completed to stop the operation of the motor (S150). When the operation of the motor is stopped and thereby the operation of the coin sorting apparatus is stopped, it is preferable to let the user know by making a sound.

When the user does not turn the power off or the number of sorted coins is continuously varied, it is determined if the counted number is identical to the preset number (S160). When the counted number is identical to the preset number, the operation of the motor is stopped (S170). At this point, the speaker makes a predetermined sound and the control/display part displays the number of sorted coins and the current operation states for the user.

When the operation of the motor is stopped, it is determined if the receiving container is displaced (S180). When the receiving container is moved, the motor starts its operation again (S120).

The operation of the coin sorting apparatus of the present invention will be described again hereinafter. The coins sorted by the coin sorting means 101 are received in the second coin receiving tube 40*b*. At this point, the number of sorted coins is detected by the first sensing means 90 mounted on the guide 30.

When a predetermined number of coins are received in the second coin receiving tube 40*b* through the guide 30, the sensing means 90 detects it to stop the operation of the coin sorting means 101 through the microcomputer 100.

At this point, the microcomputer 100 generates a sound letting the user know the current operation state through the speaker 80.

When the user pulls the handle 41*b* such that the first coin receiving tube 40*a* is displaced to the coin receiving location, the second sensing means 91 detects it to operate the coin sorting means 101 again.

When the first coin receiving tube 40*a* is also filled with the predetermined number of coins, the operation of the coin sorting means 101 is stopped by the first sensing means 90 and the microcomputer 100, after which the user takes the first coin receiving tube 40*a* out of the receiving container 41, and then mounts the second and auxiliary coin receiving tubes 40*b* and 40*c* on locations for the first and second coin receiving tubes 40*a* and 40*b*, respectively.

After the above, when the receiving container 41 is inserted to the initial location, the coin sorting apparatus starts its operation again.

When the number of coins detected by the first sensing means 90 is not varied for a predetermined time, the microcomputer 100 determines that all of the coins are sorted to stop the operation of the coin sorting means.

The user can identify the amount and number of coins being received in the current coin receiving tube and the amount and number of coins that have already been sorted and received in the coin sorting tubes, having been taken out of the apparatus and wrapped up through the control/display part 70.

As described above, since the operation of the apparatus is automatically stopped when the coin receiving tube is fully filled with the coins, an overflowing problem of the coins can be solved.

In addition, when all of the coins are sorted and thereby there are no coins in the carrier container, the operation of the apparatus is automatically stopped after a predetermined time has lapsed even when the user does not turn the power off.

Furthermore, since the user can wrap up the coins while the coins are being sorted, the work efficiency can be improved.

In addition, the user can easily identify the amount and number of sorted coins.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A coin sorting apparatus comprising:

a coin sorting member configured to sort coins according to the size of the coins;

a guide configured to transfer the coins sorted by the coin sorting member to a predetermined location;

a first sensor formed on the guide and configured to count the number of the coins being sorted;

a plurality of coin receiving tubes disposed on an end portion of the guide, said tubes being configured to receive the coins transferred from the guide according to the size of the coins;

a plurality of receiving containers configured to receive the plurality of coin receiving tubes, each of the plurality of receiving containers being provided at a lower side with a sliding projection and wherein each of the plurality of receiving containers includes a plurality of coin receiving tubes of the same size;

a sliding member provided with a plurality of sliding grooves engaged with the sliding projections so that the plurality of receiving containers can be individually inserted and withdrawn;

a second sensor including two sensor elements arranged on opposed sides of the sliding member to transmit signals to each other to detect a state variation and configured to detect if the coin receiving tubes are positioned on a first location and a second location for appropriately receiving the coins by sensing a displacement of the receiving container;

a microcomputer configured to control the coin sorting apparatus in accordance with signals from the first and second sensor; and wherein when one of the plurality of coin receiving tubes of the same size is positioned to receive the coins, another of the plurality of coin receiving tubes of the same size is positioned to be taken out of the receiving container.

2. The coin sorting apparatus of claim 1, further comprising a speaker configured to make a predetermined sound according to an operation state of the coin sorting member.

3. The coin sorting apparatus of claim 1, further comprising a control/display part configured to control and display an operation state of the coin sorting member.

4. The coin sorting apparatus of claim 1, wherein the first sensor and the second sensor are formed of an optical sensor.

5. The coin sorting apparatus of claim 1, wherein the coin sorting member comprises a motor, a rotational shaft driven by the motor, a carrier container coupled on the rotational shaft and provided with carrier holes through which the coins are carried one by one, and a separation member provided with a plurality of separation holes having different sizes, the separation holes being formed corresponding to the carrier holes to separate the coins according to size.

6. The coin sorting apparatus of claim 1, wherein the sliding projection comprises an extending portion extending downward from the receiving container, upper and lower plates disposed around the extending portion, and an elastic member disposed around the extending portion between the upper and lower plates to bias the upper plate upward to create friction force between the sliding member and the upper plate.

7. The coin sorting apparatus of claim 1, wherein the microcomputer controls the coin sorting apparatus such that the number or amount of coins being received in the coin receiving tube in the course of the operation of the coin sorting member and the number or amount of coins received in the coin receiving tube when the operation of the coin sorting member is stopped can be distinguishably displayed.

8. The coin sorting apparatus of claim 1, wherein the first sensor is formed to be offset from a center of the guide.

9. A coin sorting apparatus comprising:

a coin sorting member configured to sort coins according to the size of the coins;

a plurality of guides configured to transfer the coins sorted by the coin sorting member to a predetermined location;

a first sensor formed on each of the guides, configured to count the number of the coins being sorted;

a plurality of coin receiving tubes disposed on an end portion of each of the guides, said tubes being configured to receive the coins transferred from the guides;

a plurality of receiving containers configured to receive the plurality of coin receiving tubes, each of the plurality of the receiving containers being provided at a lower side with a sliding projection and wherein each of the plurality of receiving containers includes a plurality of coin receiving tubes of the same size;

a sliding member provided with a plurality of sliding grooves engaged with the sliding projection so that the receiving containers can be inserted and withdrawn;

a microcomputer configured to control the coin sorting apparatus in accordance with a signal from the first sensor;

wherein the plurality of sliding grooves are formed on the same horizontal plane; and wherein when one of the plurality of coin receiving tubes of the same size is positioned to receive the coins, another of the plurality of coin receiving tubes of the same size is positioned to be taken out of the receiving container.

10. The coin sorting apparatus of claim 9 further comprising a speaker configured to make a predetermined sound according to an operation state of the coin sorting member.

11. The coin sorting apparatus of claim 9 further comprising a control/display part configured to control and display an operation state of the coin sorting member.

12. The coin sorting apparatus of claim 9, wherein the sensor is formed of an optical sensor.

13. The coin sorting apparatus of claim 9, wherein the coin sorting member comprises a motor, a rotational shaft driven by the motor, a carrier container coupled on the rotational shaft and provided with carrier holes through which the coins are carried one by one, and a separation member provided with a plurality of separation holes having different sizes, the separation holes being formed corresponding to the carrier holes to separate the coins according to size.

14. The coin sorting apparatus of claim 9, wherein the microcomputer controls the coin sorting apparatus such that the number or amount of coins being received in the coin receiving tube in the course of the operation of the coin sorting member and the number or amount of coins received in the coin receiving tube when the operation of the coin sorting member is stopped can be displayed.

15. The coin sorting apparatus of claim 9, wherein the first sensor is formed to be offset from a center of the guide.

16. A coin sorting apparatus comprising:

a coin sorting member configured to sort coins according to the size of the coins;

a plurality of guides configured to transfer the coins sorted by the coin sorting member to a predetermined location;

a first sensor formed on each of the guides, configured to count the number of the coins being sorted;

a plurality of coin receiving tubes disposed on an end portion of each of the guides, said tubes being configured to receive the coins transferred from the guides;

a plurality of receiving containers configured to receive the plurality of coin receiving tubes, each of the plurality of the receiving containers being provided at a lower side with a sliding projection and including a plurality of coin receiving tubes of the same size, each said sliding projection comprising an extending portion extending downwardly from the receiving container, upper and lower plates disposed around the extending portion, and an elastic member disposed around the extending portion between the upper and lower plates to bias the upper plate upwardly to create friction force between the sliding member and the upper plate;

a sliding member provided with a sliding groove engaged with the sliding projection so that the receiving container can be inserted and withdrawn;

a microcomputer for controlling the coin sorting apparatus in accordance with a signal from the first sensing means; and wherein when one of the plurality of coin receiving tubes of the same size is positioned to receive the coins, another of the plurality of coin receiving tubes of the same size is positioned to be taken out of the receiving container.

17. A coin sorting apparatus comprising:

a coin sorting member configured to sort coins according to the size of the coins;

a guide configured to transfer the coins sorted by the coin sorting member to a predetermined location;

a plurality of coin receiving tubes disposed on an end portion of the guide, said tubes being configured to receive the coins transferred from the guide;

a plurality of receiving containers configured to receive the plurality of coin receiving tubes, each of the plurality of the receiving containers being provided at a lower side with a sliding projection and wherein each of the plurality of receiving containers includes a plurality of coin receiving tubes of the same size;

a sliding member provided with a plurality of sliding grooves engaged with the sliding projection so that the plurality of receiving containers can be individually inserted and withdrawn;

a receiving container detecting sensor including two sensor elements arranged on opposed sides of the sliding member to transmit signals to each other to detect a state variation and configured to detect if the coin receiving tubes are positioned on a first location and a second location for appropriately receiving the coins by sensing a displacement of the receiving container;

a microcomputer configured to control the coin sorting apparatus in accordance with signals from the receiving container detecting sensor; and wherein when one of the plurality of coin receiving tubes of the same size is positioned to receive the coins, another of the plurality of coin receiving tubes of the same size is positioned to be taken out of the receiving container.

18. The coin sorting apparatus of claim 17, wherein the receiving container detecting sensor is an optical sensor.

19. The coin sorting apparatus of claim 17, wherein the coin sorting member comprises a motor, a rotational shaft driven by the motor, a carrier container coupled on the rotational shaft and provided with carrier holes through which the coins are carried one by one, and a separation member provided with a plurality of separation holes having different sizes, the separation holes being formed corresponding to the carrier holes to separate the coins according to size.

20. The coin sorting apparatus of claim 17, wherein the sliding projection comprises an extending portion extending downward from the receiving container, upper and lower plates disposed around the extending portion, and an elastic member disposed around the extending portion between the upper and lower plates to bias the upper plate upward to create friction force between the sliding member and the upper plate.

21. A coin sorting apparatus comprising:

a coin sorting member configured to sort coins according to the size of the coins;

a guide configured to transfer the coins sorted by the coin sorting member to a predetermined location;

a plurality of coin receiving tubes configured to receive the coins transferred from the guide;

a receiving container configured to receive the plurality of coin receiving tubes, and wherein the receiving containers includes a plurality of coin receiving tubes of the same size;

a sliding member provided with a sliding groove engaged with the receiving container so that the receiving container can be inserted and withdrawn;

a receiving container detecting sensor including two sensor elements arranged on opposed sides of the sliding member to transmit signals to each other to detect a state variation and configured to detect if the coin receiving tube is positioned on a first location and a second location for appropriately receiving the coins by sensing a displacement of the receiving container;

a microcomputer configured to control the coin sorting apparatus in accordance with a signal from the receiving container detecting sensor; and wherein when one of the plurality of coin receiving tubes of the same size is positioned to receive the coins, another of the plurality of coin receiving tubes of the same size is positioned to be taken out of the receiving container.

22. The coin sorting apparatus of claim 21, further comprising:

a coin detecting sensor configured to count the number of the coins being sorted; and a display device configured to display the number of sorted coins in accordance with a signal detected by the coin detecting sensor.

23. A coin sorting apparatus comprising:

a coin sorting member configured to sort coins according to the size of the coins;

a guide configured to transfer the coins sorted by the coin sorting member to a predetermined location;

a coin receiving tube configured to receive the coins transferred from the guide;

a receiving container configured to receive the coin receiving tube;

a sliding member provided with a sliding groove engaged with the receiving container so that the receiving container can be inserted and withdrawn;

a first sensor configured to count the number of coins being sorted according to the size of the coins;

a second sensor including two sensor elements arranged on opposed sides of the sliding member to transmit signals to each other to detect a state variation and configured to detect if the coin receiving tube is positioned on a first location, a second location and third location for appropriately receiving the coins by sensing a displacement of the receiving container;

a microcomputer configured to control the coin sorting apparatus in accordance with signals from the first and second sensor;

wherein if the coin receiving tube is positioned on the first location and the second location, the microcomputer controls the coin sorting member to sort coins;

wherein if the coin receiving tube is positioned on the third location, the microcomputer controls the coin sorting member to stop sorting coins, and wherein when the receiving container moves on the sliding member, the coin receiving tube is positioned on the first location, the second location and the third location.

24. The coin sorting apparatus of claim 23, further comprising a speaker configured to make a predetermined sound when it is determined by the first sensor that a predetermined number of the coins are sorted or the operation of the coin sorting member is stopped.

25. The coin sorting apparatus of claim 23, further comprising a control/display part configured to control and display an operation state of the coin sorting member.

26. The coin sorting apparatus of claim 23, further comprising:

a user interface configured to allow a user to control the coin sorting apparatus and display an operation state of the coin sorting apparatus.

27. The coin sorting apparatus of claim 26, wherein the user interface comprises a plurality of control buttons and a display part.

28. The coin sorting apparatus of claim 26, wherein the microcomputer controls the coin sorting apparatus such that amounts of the coins sorted by the size or a total amount of the sorted coins can be displayed.

29. The coin sorting apparatus of claim 26, wherein the microcomputer controls the coin sorting apparatus such that the number of coins sorted by size can be displayed within a predetermined range.

30. The coin sorting apparatus of claim 26, wherein the microcomputer controls the coin sorting apparatus such that the number of coins being received in the coin receiving tube in the course of the operation of the coin sorting member and the number of coins received in the coin receiving tube when the operation of the coin sorting member is stopped can be distinguishably displayed.

31. A coins sorting apparatus comprising:

a coin sorting member configured to sort coins according to size of the coins;

a guide configured to transfer the coins sorted by the coin sorting member to a predetermined location;

a plurality of coin receiving tubes configured to receive the coins transferred from the guide;

a plurality of receiving containers configured to receive the plurality of coin receiving tubes, each of the plurality of receiving containers being provided at a lower side with a sliding projection, wherein each of the plurality of receiving containers receives a plurality of coin receiving tubes of the same size;

a sliding member disposed below the plurality of receiving containers and provided with a plurality of sliding grooves engaged with the sliding projection so that the plurality of receiving containers can be individually inserted and withdrawn; and wherein the plurality of coin receiving tubes include a first, a second and a third coin receiving tubes designed in an identical size to receive an identical size of coins, and wherein the first, second, and third coin receiving tubes are received in a single receiving container.

32. The coin sorting apparatus of claim 31, wherein the first coin receiving tube and the second coin receiving tube are located on a first horizontal plane and the third coin receiving tube is located on a second horizontal plane, and wherein the second horizontal plane is lower than the first horizontal plane.

* * * * *